US011629308B2

(12) United States Patent
Salvi et al.

(10) Patent No.: US 11,629,308 B2
(45) Date of Patent: Apr. 18, 2023

(54) LOW VISCOSITY GEAR OIL COMPOSITIONS FOR ELECTRIC AND HYBRID VEHICLES

(71) Applicant: EXXONMOBIL TECHNOLOGY AND ENGINEERING COMPANY, Annandale, NJ (US)

(72) Inventors: Luca Salvi, Haddonfield, NJ (US); Zhisheng Gao, Flemington, NJ (US); Abigail R. Van Wassen, Florham Park, NJ (US); Martin N. Webster, Pennington, NJ (US)

(73) Assignee: EXXONMOBIL TECHNOLOGY AND ENGINEERING COMPANY, Annandale, NJ (US)

( * ) Notice: Subject to any disclaimer, the term of this patent is extended or adjusted under 35 U.S.C. 154(b) by 75 days.

(21) Appl. No.: 16/744,670

(22) Filed: Jan. 16, 2020

(65) Prior Publication Data

US 2020/0277542 A1 Sep. 3, 2020

Related U.S. Application Data

(60) Provisional application No. 62/811,602, filed on Feb. 28, 2019.

(51) Int. Cl.

| | |
|---|---|
| ***C10M 169/04*** | (2006.01) |
| ***C10M 171/02*** | (2006.01) |
| *C10N 20/02* | (2006.01) |
| *C10N 30/02* | (2006.01) |
| *C10N 30/10* | (2006.01) |
| *C10N 40/04* | (2006.01) |
| *C10N 40/14* | (2006.01) |

(52) U.S. Cl.

CPC ..... *C10M 169/04* (2013.01); *C10M 171/02* (2013.01); *C10M 2203/003* (2013.01); *C10M 2203/1025* (2013.01); *C10M 2205/0285* (2013.01); *C10N 2020/02* (2013.01); *C10N 2030/02* (2013.01); *C10N 2030/10* (2013.01); *C10N 2040/04* (2013.01); *C10N 2040/14* (2013.01)

(58) Field of Classification Search

CPC ..... C10M 169/04; C10M 171/02

See application file for complete search history.

(56) References Cited

U.S. PATENT DOCUMENTS

| | | | | |
|---|---|---|---|---|
| 1,390,359 | A | 9/1921 | Kehoe et al. | |
| 3,250,715 | A | 5/1966 | Wyman et al. | |
| 3,595,791 | A | 7/1971 | Cohen et al. | |
| 3,803,039 | A | 4/1974 | Piasek et al. | |
| 3,948,800 | A | 4/1976 | Meinhardt et al. | |
| 4,149,178 | A | 4/1979 | Estes | |
| 4,218,330 | A | 8/1980 | Shubkin | |
| 4,234,435 | A | 11/1980 | Meinhardt et al. | |
| 4,426,305 | A | 1/1984 | Malec | |
| 4,767,551 | A | 8/1988 | Hunt et al. | |
| 4,952,739 | A | 8/1990 | Chen | |
| 4,975,177 | A | 12/1990 | Garwood et al. | |
| 5,068,487 | A | 11/1991 | Theriot | |
| 5,075,269 | A | 12/1991 | Degnan et al. | |
| 5,084,197 | A | 1/1992 | Galic | |
| 5,360,564 | A * | 11/1994 | Sutherland | C10M 143/12 525/190 |
| 5,366,648 | A | 11/1994 | Salomon et al. | |
| 5,382,739 | A | 1/1995 | Atkins et al. | |
| 5,430,105 | A | 7/1995 | Redpath et al. | |
| 5,705,458 | A | 1/1998 | Roby et al. | |
| 6,034,039 | A | 3/2000 | Gomes et al. | |
| 6,165,949 | A | 12/2000 | Berlowitz et al. | |
| 6,323,164 | B1 | 11/2001 | Liesen et al. | |
| 6,455,711 | B1 | 9/2002 | Eller et al. | |
| 7,041,752 | B2 | 5/2006 | Schlitter et al. | |
| 8,048,833 | B2 | 11/2011 | Habeeb et al. | |
| 9,200,230 | B2 * | 12/2015 | Youn | C10M 141/04 |
| 2008/0110799 | A1 * | 5/2008 | Matsui | C10M 169/04 208/19 |
| 2009/0036725 | A1 | 2/2009 | Wu | |
| 2010/0035777 | A1 * | 2/2010 | Sano | C10M 101/02 208/18 |

(Continued)

FOREIGN PATENT DOCUMENTS

| | | | | |
|---|---|---|---|---|
| EP | 464546 | A1 | 1/1992 | |
| EP | 464547 | A1 | 1/1992 | |
| WO | 2007011832 | A1 | 1/2007 | |
| WO | WO-2016174186 | A1 * | 11/2016 | C08L 53/005 |

OTHER PUBLICATIONS

The International Search Report and Written Opinion of PCT/US2020/013835 dated Jul. 8, 2020.

*Primary Examiner* — Randy Boyer

(74) *Attorney, Agent, or Firm* — Vorys, Sater, Seymour and Pease LLP

(57) ABSTRACT

This disclosure relates to a lubricating oil (e.g., gear oil) for use in an electric or hybrid vehicle. The lubricating oil has a composition including one or more lubricating oil base stocks as a major component, and one or more lubricating oil additives, as a minor component. The one or more lubricating oil base stocks include at least one Group IV base oil, or at least one Group V base oil. The lubricating oil has a kinematic viscosity ($KV_{100}$) from 1 cSt to 7 cSt at 100° C. as determined by ASTM D-445, and an electrical conductivity at room temperature of less than 15,000 pS/m as determined by ASTM D-2624. This disclosure also relates to methods for producing a lubricating oil for a transmission, gear train, gear set, gear box, or gears of an electric vehicle powertrain and methods for improving energy efficiency, while maintaining or improving wear control.

10 Claims, 2 Drawing Sheets

(56) References Cited

U.S. PATENT DOCUMENTS

| | | | |
|---|---|---|---|
| 2013/0005633 | A1 | 1/2013 | Habeeb et al. |
| 2017/0073611 | A1 | 3/2017 | Greaves et al. |
| 2018/0100115 | A1 | 4/2018 | Gao et al. |
| 2018/0100118 | A1 | 4/2018 | Flores-Torres et al. |
| 2018/0100120 | A1* | 4/2018 | Flores-Torres ..... C10M 101/02 |
| 2018/0119050 | A1 | 5/2018 | Gibson et al. |
| 2018/0134983 | A1* | 5/2018 | Broutin ..... C08L 53/005 |
| 2018/0273870 | A1 | 9/2018 | Burns, III et al. |

* cited by examiner

Fig. 1

| | IE #1 | IE #2 | IE #3 | IE #4 | IE #5 | IE #6 | IE #7 | IE #8 | IE #9 | IE #10 | IE #11 | IE #12 | IE #13 | CE #1 | CE #2 |
|---|---|---|---|---|---|---|---|---|---|---|---|---|---|---|---|
| Base Oil 1 | 22.9 | 45.8 | 68.7 | | | | 83.4 | | 91.6 | 87.6 | 82.6 | 77.1 | | 67.0 | |
| Base Oil 2 | 68.7 | 45.8 | 22.9 | 90 | | 79.5 | | 91.6 | | | | | 23.9 | | 28.5 |
| Base Oil 3 | | | | | | | | | | | | | | | |
| Base Oil 4 | | | | | | | | | | | | | 67.7 | 24.6 | 63.1 |
| Base Oil 5 | | | | 1.6 | | 13.1 | 8.2 | | | 4.0 | 9.0 | 14.5 | | | |
| Base Oil 6 | | | | | 91.6 | | | | | | | | | | |
| Aminiric AO | | | | | | | | | | | | | | | |
| Phenolic AO | | | | | | | | | | | | | | | |
| Molybdenum | | | | | | | | | | | | | | | |
| Dispersant | | | | | | | | | | | | | | | |
| EP - N/S/P | | | | | | | | | | | | | | | |
| Ashless P Antiwear | | | | | | | | | | | | | | | |
| AW/EP - S/P | | | | | | | | | | | | | | | |
| AdPack | 8.4 | 8.4 | 8.4 | 8.4 | 8.4 | 8.4 | 8.4 | 8.4 | 8.4 | 8.4 | 8.4 | 8.4 | 8.4 | 8.4 | 8.4 |
| Total | 100 | 100 | 100 | 100 | 100 | 100 | 100 | 100 | 100 | 100 | 100 | 100 | 100 | 100 | 100 |
| KV80, cSt | 2.02 | 2.19 | 2.38 | 2.23 | 2.43 | 6.21 | 5.99 | 1.87 | 2.6 | 3.97 | 5.67 | 8.71 | 4.9 | not homogeneous mixture | 13.09 |
| KV100, cSt | 1.56 | 1.68 | 1.81 | 1.72 | 1.80 | 4.59 | 4.28 | 1.46 | 1.95 | 2.91 | 4.06 | 6.07 | 3.82 | | 8.41 |
| Conductivity, pS/m | 2680 | 2200 | 1856 | 2720 | 100 | 994 | 701 | 3110 | 1182 | 960 | | | 0 | | 97800 |
| CoF, 80 C, 1.25GPa, 100SRR | 0.0198 | 0.0237 | 0.0245 | 0.0184 | 0.0284 | 0.0192 | 0.0215 | 0.0266 | 0.0236 | 0.0222 | 0 | 0 | 0.0197 | | 0.0157 |
| DIN ISO 14635* | Pass >13 stage | | | | | | | | | | | | | | Pass >13 stage |
| **Thermal Conductivity, W/m*K** | | | | | | | | | | | | | | | |
| 20C | | | | | | | | | 0.15 | 0.14 | | | | | |
| 40C | 0.14 | | | | 0.14† | | | | 0.14 | | | | 0.16† | | 0.16† |
| 60C | | | | | | | | | 0.14 | | | | | | |
| 100C | | | | | | | | | | | | | 0.15† | | 0.15† |
| 150C (extrapolated) | | | | | | | | | | | | | 0.14† | | 0.14† |
| **Specific Heat by DSC, cal/g*C** | | | | | | | | | | | | | | | |
| 20C | 0.481 | | | | 0.495† | | | | | 0.502 | | | 0.420† | | 0.426† |
| 80C | 0.54 | | | | 0.565† | | | | | 0.568 | | | 0.471† | | 0.474† |
| 120C | 0.571 | | | | 0.599† | | | | | 0.595 | | | 0.504† | | 0.506† |
| 160C | 0.602 | | | | 0.631† | | | | | 0.616 | | | 0.522† | | 0.524† |
| 200C | 0.646 | | | | 0.656† | | | | | 0.635 | | | | | |

* Test modified to run up to stage 13, instead of stopping at stage 12

†Data based on weighted average of base oil components

Fig. 2

| | IE #14 | IE #15 | IE #14 | IE #15 | IE #16 | IE #17 | IE #18 | IE #19 | IE #20 | IE #21 | IE #22 | IE #23 | CE #1 | CE #2 |
|---|---|---|---|---|---|---|---|---|---|---|---|---|---|---|
| Base Oil 1 | | | 23.7 | 47.4 | 71.1 | 23.7 | 47.4 | 71.1 | | | | | 67.0 | |
| Base Oil 2 | | | 71.1 | 47.4 | 23.7 | 71.1 | 47.4 | 23.7 | | | | | | 28.5 |
| Base Oil 3 | 69.6 | 61.6 | | | | | | | 50.9 | 47.3 | 53.3 | 33.0 | | |
| Base Oil 4 | 23.0 | 30.0 | | | | | | | 41.3 | 44.3 | 38.3 | 58.6 | 24.6 | 63.1 |
| Base Oil 5 | | | | | | | | | | | | | | |
| Base Oil 6 | | | | | | | | | | | | | | |
| Aminimic AO | | | 0.7 | 0.7 | 0.7 | 0.7 | 0.7 | 0.7 | | | | | | |
| Phenolic AO | | | 0.8 | 0.8 | 0.8 | 0.8 | 0.8 | 0.8 | | | | | | |
| Molybdenum | | | 0.9 | 0.9 | 0.9 | 0.9 | 0.9 | 0.9 | | | | | | |
| Dispersant | | | 1.5 | 1.5 | 1.5 | 1.5 | 1.5 | 1.5 | | | | | | |
| EP - N/S/P | | | 0.1 | 0.1 | 0.1 | 0.3 | 0.3 | 0.3 | | | | | | |
| Ashless P Antiwear | | | 0.3 | 0.3 | 0.3 | 0.1 | 0.1 | 0.1 | | | | | | |
| AW/EP - S/P | | | 1.0 | 1.0 | 1.0 | 1.0 | 1.0 | 1.0 | | | | | | |
| AdPack | 8.4 | 8.4 | | | | | | | 8.4 | 8.4 | 8.4 | 8.4 | 8.4 | 8.4 |
| Total | 100 | 100 | 100 | 100 | 100 | 100 | 100 | 100 | 100 | 100 | 100 | 100 | 100 | 100 |
| KV80, cSt | 4.13 | 5.13 | 2.23 | 2.41 | 2.62 | 2.22 | 2.41 | 2.62 | 7.24 | 7.9 | 6.55 | 11.5 | not homogenous mixture | 13.09 |
| KV100, cSt | 2.96 | 3.61 | 1.72 | 1.84 | 1.99 | 1.72 | 1.85 | 1.99 | 4.91 | 5.33 | 4.53 | 7.40 | | 8.41 |
| Conductivity, pS/m | 0 | 0 | 8060 | 6610 | 5120 | 12500 | 10070 | 7590 | | | | | | 97800 |
| CoF, 80 C, 1.25GPa, 100SRR | 0.0186 | 0 | 0.0211 | 0.0268 | 0.0226 | 0.0196 | 0.0230 | 0.0216 | 0.0174 | | 0.0176 | 0.0166 | | 0.0157 |
| DIN ISO 14635* | | | | | | | | | | | | | | Pass >13 stage |
| **Thermal Conductivity, W/m*K** | | | | | | | | | | | | | | |
| 20C | 0.15 | | | | | | | | | | | | | |
| 40C | 0.15 | | | | | | | | | | | | | 0.16† |
| 60C | 0.14 | | | | | | | | | | | | | |
| 100C | | | | | | | | | | | | | | 0.15† |
| 150C (extrapolated) | | | | | | | | | | | | | | 0.14† |
| **Specific Heat by DSC, cal/g*C** | | | | | | | | | | | | | | |
| 20C | | | | | | | | | | | | | | 0.426† |
| 80C | | | | | | | | | | | | | | 0.474† |
| 120C | | | | | | | | | | | | | | 0.506† |
| 160C | | | | | | | | | | | | | | 0.524† |
| 200C | | | | | | | | | | | | | | |

* Test modified to run up to stage 13, instead of stopping at stage 12

†Data based on weighted average of base oil components

LOW VISCOSITY GEAR OIL COMPOSITIONS FOR ELECTRIC AND HYBRID VEHICLES

CROSS-REFERENCE TO RELATED APPLICATIONS

This application claims the benefit of U.S. Provisional Application No. 62/811,602, filed on Feb. 28, 2019, the entire contents of which are incorporated herein by reference.

FIELD

This disclosure provides low viscosity gear oils for electric and hybrid vehicles. This disclosure also provides methods for lubricating one or more gear components (e.g., transmission, gear train, gear set, or gear box) of electric or hybrid vehicles. This disclosure further provides methods for producing low viscosity gear oils for use in electric or hybrid vehicles. This disclosure still further provides methods for improving energy efficiency, while maintaining or improving wear control, in gear components (e.g., transmission, gear train, gear set, or gear box) of electric or hybrid vehicles.

BACKGROUND

Conventional gear oil formulations are typically blended at high viscosity to guarantee equipment protection for the duration of gear components such as the transmission, gear train, gear set, or gear box. Increasing demand for efficiency gain across the whole powertrain of modern vehicles is driving toward the definition of low viscosity gear oils that can provide the same durability as that offered by the higher viscosity products.

Gear oil lubricating properties must be maintained over the lifetime of the gear oil despite exposure to high surface temperatures of electrical components in electric and hybrid vehicles. Gear oil stability must be balanced with other lubricant properties such as viscosity, thermal and electrical conductivities, durability performance, and achieving good gear protection.

Combining the demands for efficiency gains along with the need to design gear fluids capable of functioning in highly electrified vehicles (hybrids, full electric vehicle, etc.), creates a new set of formulation parameters that need to be addressed. In particular, developing gear oils that afford improved energy efficiency and wear control, in gear components such as the transmission, gear train, gear set, or gear box of an electric or hybrid vehicle, needs to be addressed.

A major challenge in electric vehicle lubricant formulation is developing low viscosity gear oils that can provide the same durability as that offered by the higher viscosity products over the lifetime of the lubricant. In particular, the challenge in electric vehicle lubricant formulations is achieving improved energy efficiency and wear control over a broad temperature range over the lifetime of the lubricant.

Despite advances in lubricant oil formulation technology in electric and hybrid vehicles, there exists a need for electric or hybrid vehicle gear oil formulations having improved energy efficiency and wear control over the lifetime of the gear oil.

SUMMARY

This disclosure provides low viscosity lubricating oils (e.g., gear oils) for electric and hybrid vehicles. This disclosure also provides methods for lubricating one or more gear components (e.g., transmission, gear train, gear set, or gear box) of electric or hybrid vehicles. This disclosure further provides methods for producing low viscosity lubricating oils (e.g., gear oils) for use in electric or hybrid vehicles. This disclosure still further provides methods for improving energy efficiency, while maintaining or improving wear control, in gear components (e.g., transmission, gear train, gear set, or gear box) of electric or hybrid vehicles. The low viscosity lubricating oils can serve as a cooling fluid for electric and hybrid vehicles as well as mechanical and electrical systems, subsystems, and components for such vehicles.

This disclosure relates in part to a lubricating oil (e.g., gear oil) for use in an electric or hybrid vehicle. The lubricating oil has a composition comprising one or more lubricating oil base stocks as a major component, and one or more lubricating oil additives as a minor component. The one or more lubricating oil base stocks comprise at least one Group IV base oil, or at least one Group V base oil. The lubricating oil has a kinematic viscosity ($KV_{100}$) from about 1 cSt to about 7 cSt at 100° C. as determined by ASTM D-445, and an electrical conductivity at room temperature of less than about 15,000 pS/m as determined by ASTM D-2624.

This disclosure also relates in part to a method for producing a lubricating oil for a transmission, gear train, gear set, gear box, or gears of an electric or hybrid vehicle. The method comprises: providing one or more lubricating oil base stocks, in which the one or more lubricating oil base stocks comprise at least one Group IV base oil, or at least one Group V base oil; providing one or more lubricating oil additives; and blending the one or more lubricating oil base stocks and the one or more lubricating oil additives in amounts sufficient to produce the lubricating oil. The lubricating oil has a kinematic viscosity ($KV_{100}$) from about 1 cSt to about 7 cSt at 100° C. as determined by ASTM D-445, and an electrical conductivity at room temperature of less than about 15,000 pS/m as determined by ASTM D-2624.

This disclosure further relates in part to a method for improving energy efficiency, while maintaining or improving wear control, in a transmission, gear train, gear set, gear box, or gears of an electric or hybrid vehicle. The method comprises using a lubricant composition in the transmission, gear train, gear set, gear box, or gears of an electric or hybrid vehicle. The lubricant composition comprises one or more lubricating oil base stocks as a major component, and one or more lubricating oil additives as a minor component. The one or more lubricating oil base stocks comprise at least one Group IV base oil, or at least one Group V base oil. The lubricating oil has a kinematic viscosity ($KV_{100}$) from about 1 cSt to about 7 cSt at 100° C. as determined by ASTM D-445, and an electrical conductivity at room temperature of less than about 15,000 pS/m as determined by ASTM D-2624.

In accordance with this disclosure, the lubricating oil has a kinematic viscosity ($KV_{100}$) from about 1 cSt to about 7 cSt at 100° C. as determined by ASTM D-445, and an electrical conductivity at room temperature of less than about 15,000 pS/m as determined by ASTM D-2624. Preferably, the lubricating oil has a kinematic viscosity ($KV_{100}$) from about 1 cSt to about 5 cSt at 100° C. as determined by ASTM D-445, and an electrical conductivity at room temperature of less than about 15,000 pS/m as determined by ASTM D-2624. More preferably, the lubricating oil has a kinematic viscosity ($KV_{100}$) from about 1 cSt to about 3 cSt at 100° C. as determined by ASTM D-445, and an electrical conductivity at room temperature of less than about 15,000 pS/m as determined by ASTM D-2624.

In accordance with this disclosure, the lubricating oil has a coefficient of traction (CoT) of less than about 0.0350 as measured using a mini traction machine (MTM) at 80° C. and 1.25 GPa load at 100% slide to roll ratio (SRR), and a durability performance passing at least stage 12, as determined by method DIN ISO 14635 (FZG Scuffing). Preferably, the lubricating oil has a coefficient of traction (CoT) of less than about 0.0250 as measured using a mini traction machine (MTM) at 80° C. and 1.25 GPa load at 100% slide to roll ratio (SRR), and a durability performance passing at least stage 12, as determined by method DIN ISO 14635 (FZG Scuffing). More preferably, the lubricating oil has a coefficient of traction (CoT) of less than about 0.0200 as measured using a mini traction machine (MTM) at 80° C. and 1.25 GPa load at 100% slide to roll ratio (SRR), and a durability performance passing at least stage 12, as determined by method DIN ISO 14635 (FZG Scuffing).

This disclosure yet further relates in part to a cooling fluid for use in an electric or hybrid vehicle. The cooling fluid has a composition comprising one or more lubricating oil base stocks as a major component, and one or more lubricating oil additives as a minor component. The one or more lubricating oil base stocks comprise at least one Group IV base oil, or at least one Group V base oil. The one or more lubricating oil additives comprise an antioxidant, preferably a phenolic antioxidant. The cooling fluid has a kinematic viscosity ($KV_{100}$) from about 1 cSt to about 7 cSt at 100° C. as determined by ASTM D-445.

It has been surprisingly found that, in accordance with this disclosure, improvement in energy efficiency is obtained, while wear control is improved or maintained, in a gear component (e.g., a transmission, gear train, gear set, or gear box) of an electric or hybrid vehicle, by using a gear oil having a unique selection of base oils, namely one or more lubricating oil base stocks having at least one Group IV base oil, or at least one Group V base oil. The selection of the one or more lubricating oil base stocks having at least one Group IV base oil, or at least one Group V base oil, affords control and design of sought after gear oil properties for electric or hybrid vehicles including low viscosity, low conductivity, high efficiency and good durability.

In particular, it has been surprisingly found that, in accordance with this disclosure, based on the selection of one or more lubricating oil base stocks having at least one Group IV base oil, or at least one Group V base oil, gear oil properties can be controlled or designed to provide gear oils for electric or hybrid vehicles having a kinematic viscosity ($KV_{100}$) from about 1 cSt to about 7 cSt at 100° C. as determined by ASTM D-445; an electrical conductivity at room temperature of less than about 15,000 pS/m as determined by ASTM D-2624; a coefficient of traction (CoT) of less than about 0.0350 as measured using a mini traction machine (MTM) at 80° C. and 1.25 GPa load at 100% slide to roll ratio (SRR); and a durability performance passing at least stage 12, as determined by method DIN ISO 14635 (FZG Scuffing).

Other objects and advantages of the present disclosure will become apparent from the detailed description that follows.

BRIEF DESCRIPTION OF THE DRAWINGS

FIG. 1 shows formulations and testing results for low viscosity gear oils having a constant amount of an additive package (i.e., AdPack), in accordance with the Examples.

FIG. 2 shows formulations and testing results for low viscosity gear oils having varying amounts of additives, in accordance with the Examples.

DETAILED DESCRIPTION

Definitions

"About" or "approximately." All numerical values within the detailed description and the claims herein are modified by "about" or "approximately" the indicated value, and take into account experimental error and variations that would be expected by a person having ordinary skill in the art.

"Major amount" as it relates to components included within the lubricating oils of the specification and the claims means greater than or equal to 50 wt. %, or greater than or equal to 60 wt. %, or greater than or equal to 70 wt. %, or greater than or equal to 80 wt. %, or greater than or equal to 90 wt. % based on the total weight of the lubricating oil.

"Minor amount" as it relates to components included within the lubricating oils of the specification and the claims means less than 50 wt. %, or less than or equal to 40 wt. %, or less than or equal to 30 wt. %, or greater than or equal to 20 wt. %, or less than or equal to 10 wt. %, or less than or equal to 5 wt. %, or less than or equal to 2 wt. %, or less than or equal to 1 wt. %, based on the total weight of the lubricating oil.

"Essentially free" as it relates to components included within the lubricating oils of the specification and the claims means that the particular component is at 0 weight % within the lubricating oil, or alternatively is at impurity type levels within the lubricating oil (less than 100 ppm, or less than 20 ppm, or less than 10 ppm, or less than 1 ppm).

"Other lubricating oil additives" as used in the specification and the claims means other lubricating oil additives that are not specifically recited in the particular section of the specification or the claims. For example, other lubricating oil additives may include, but are not limited to, antioxidants, detergents, dispersants, antiwear additives, corrosion inhibitors, viscosity modifiers, metal passivators, pour point depressants, seal compatibility agents, antifoam agents, extreme pressure agents, friction modifiers and combinations thereof.

"Hydrocarbon" refers to a compound consisting of carbon atoms and hydrogen atoms.

"Alkane" refers to a hydrocarbon that is completely saturated. An alkane can be linear, branched, cyclic, or substituted cyclic.

"Olefin" refers to a non-aromatic hydrocarbon comprising one or more carbon-carbon double bond in the molecular structure thereof.

"Mono-olefin" refers to an olefin comprising a single carbon-carbon double bond.

"Cn" group or compound refers to a group or a compound comprising carbon atoms at total number thereof of n. Thus, "Cm-Cn" group or compound refers to a group or compound comprising carbon atoms at a total number thereof in the range from m to n. Thus, a C1-C50 alkyl group refers to an alkyl group comprising carbon atoms at a total number thereof in the range from 1 to 50.

"Carbon backbone" refers to the longest straight carbon chain in the molecule of the compound or the group in question. "Branch" refer to any substituted or unsubstituted hydrocarbyl group connected to the carbon backbone. A carbon atom on the carbon backbone connected to a branch is called a "branched carbon."

"SAE" refers to SAE International, formerly known as Society of Automotive Engineers, which is a professional organization that sets standards for internal combustion engine lubricating oils.

"SAE J300" refers to the viscosity grade classification system of engine lubricating oils established by SAE, which defines the limits of the classifications in rheological terms only.

"Base stock" or "base oil" interchangeably refers to an oil that can be used as a component of lubricating oils, heat transfer oils, hydraulic oils, grease products, and the like.

"Lubricating oil" or "lubricant" interchangeably refers to a substance that can be introduced between two or more surfaces to reduce the level of friction between two adjacent surfaces moving relative to each other. In this disclosure, the phrase "lubricating oil" also encompasses gear lubricating fluids, gear lubricants, gear lubricant oils, working fluids, cooling fluids, cooling oils, and coolants; such terms may be used interchangeably. A lubricant base stock is a material, typically a fluid at various levels of viscosity at the operating temperature of the lubricant, used to formulate a lubricant by admixing with other components. Non-limiting examples of base stocks suitable in lubricants include API Group I, Group II, Group III, Group IV, and Group V base stocks. PAOs, particularly hydrogenated PAOs, have recently found wide use in lubricants as a Group IV base stock, and are particularly preferred. If one base stock is designated as a primary base stock in the lubricant, additional base stocks may be called a co-base stock.

All kinematic viscosity values in this disclosure are as determined pursuant to ASTM D445. Kinematic viscosity at 100° C. is reported herein as KV100, and kinematic viscosity at 40° C. is reported herein as KV40. Unit of all KV100 and KV40 values herein is cSt unless otherwise specified.

All viscosity index ("VI") values in this disclosure are as determined pursuant to ASTM D2270.

All Noack volatility ("NV") values in this disclosure are as determined pursuant to ASTM D5800 unless specified otherwise. Unit of all NV values is wt %, unless otherwise specified.

All pour point values in this disclosure are as determined pursuant to ASTM D5950 or D97.

All CCS viscosity ("CCSV") values in this disclosure are as determined pursuant to ASTM 5293. Unit of all CCSV values herein is millipascal second (mPa·s), which is equivalent to centipoise), unless specified otherwise. All CCSV values are measured at a temperature of interest to the lubricating oil formulation or oil composition in question. Thus, for the purpose of designing and fabricating engine oil formulations, the temperature of interest is the temperature at which the SAE J300 imposes a minimal CCSV.

All percentages in describing chemical compositions herein are by weight unless specified otherwise. "Wt. %" means percent by weight.

"Electric vehicle" refer to in this disclosure as all-electric and fully electric vehicles, and hybrid and hybrid electric vehicles, and includes the mechanical and electrical systems, subsystems, and components having gears used in the vehicles. These mechanical and electrical systems, subsystems and components having gears can include, for example, electrical vehicle powertrains, powertrain components, drivetrain components, kinetic energy recovery systems (KERS), energy regenerative systems, and the like. The terms electric vehicle and hybrid vehicle may be used interchangeably. In this disclosure, the phrase "electric vehicle" includes hybrid and hybrid electric vehicles, which may have any of a variety of parallel or series drivetrain configurations, alone or in combination.

Gear Oil Compositions and Methods of This Disclosure

It has now been found that improved energy efficiency can be obtained, and wear control can be improved or maintained, in a gear component (e.g., a transmission, gear train, gear set, or gear box) of an electric or hybrid vehicle, by using a gear oil having a unique selection of base oils. The unique selection of base oils includes one or more lubricating oil base stocks having at least one Group IV base oil, or at least one Group V base oil. The selection of the one or more lubricating oil base stocks having at least one Group IV base oil, or at least one Group V base oil, affords control and design of desired gear oil properties for electric or hybrid vehicles including low viscosity, low conductivity, high efficiency and good durability. The lubricating oils of this disclosure are particularly advantageous as passenger electric vehicle gear oil products.

In an embodiment, energy efficiency is improved, and wear control is maintained or improved, in electric or hybrid vehicles, as compared to energy efficiency and wear control achieved using a gear lubricating oil having one or more lubricating oil base stocks other than at least one Group IV base oil, or at least one Group V base oil.

Preferably, the lubricating oil base stocks include a Group V base stock, a Group IV base stock, a blend of Group V base stocks, a blend of Group IV base stocks, a blend of a Group V base stock and a Group IV base stock; a blend of a Group V base stock and a Group III base stock; a blend of a Group IV base stock and a Group III base stock; or a blend of a Group V base stock, a Group IV base stock and a Group III base stock. The lubricating oil base stocks can be miscible, partially miscible, or non-miscible.

In another embodiment, in electric or hybrid vehicles, energy efficiency is improved, and wear control is maintained or improved, as compared to energy efficiency and wear control achieved using a lubricating oil having a kinematic viscosity ($KV_{100}$) greater than about 7 cSt at 100° C. as determined by ASTM D-445, or an electrical conductivity at room temperature of greater than about 15,000 pS/m as determined by ASTM D-2624.

The gear lubricant compositions of this disclosure provide advantaged control and design of desired gear oil properties for electric or hybrid vehicles including low viscosity, low conductivity, high efficiency and good durability. In an embodiment, a single gear lubricant composition can be used in a gear component of the electric or hybrid vehicle. In another embodiment, more than one gear lubricant composition can be used in gear components of the electric or hybrid vehicle, for example, one gear lubricant composition for the transmission and another gear lubricant composition for another gear component (e.g., gear train, gear set, or gear box).

Yet further, the gear lubricant compositions of this disclosure exhibit advantaged gear oil properties, including low viscosity, low conductivity, high efficiency and good durability, under diverse lubrication regimes of electric and hybrid vehicle gear components, that include, for example, hydrodynamic, elastohydrodynamic, boundary, mixed lubrication, extreme pressure regimes, and the like.

The gear lubricant compositions of this disclosure provide improved energy efficiency and wear control in gear components of electric or hybrid vehicles under a range of lubrication contact pressures, from 1 MPa to greater than 10

GPa, preferably greater than 10 MPa, more preferably greater than 100 MPa, even more preferably greater than 300 MPa. Under certain circumstances, the gear lubricant compositions of this disclosure provide improved energy efficiency and wear control in gear components of electric or hybrid vehicles at greater than 0.5 GPa, often at greater than 1 GPa, sometimes greater than 2 GPa, under selected circumstances greater than 5 GPa.

Further, the gear lubricant compositions of this disclosure provide advantaged improved energy efficiency and wear control in gear components of electric or hybrid vehicles on lubricated surfaces of electric or hybrid vehicle gear components that include, for example, the following: metals, metal alloys, non-metals, non-metal alloys, mixed carbon-metal composites and alloys, mixed carbon-nonmetal composites and alloys, ferrous metals, ferrous composites and alloys, non-ferrous metals, non-ferrous composites and alloys, titanium, titanium composites and alloys, aluminum, aluminum composites and alloys, magnesium, magnesium composites and alloys, ion-implanted metals and alloys, plasma modified surfaces; surface modified materials; coatings; mono-layer, multi-layer, and gradient layered coatings; honed surfaces; polished surfaces; etched surfaces; textured surfaces; micro and nano structures on textured surfaces; super-finished surfaces; diamond-like carbon (DLC), DLC with high-hydrogen content, DLC with moderate hydrogen content, DLC with low-hydrogen content, DLC with near-zero hydrogen content, DLC composites, DLC-metal compositions and composites, DLC-nonmetal compositions and composites; ceramics, ceramic oxides, ceramic nitrides, FeN, CrN, ceramic carbides, mixed ceramic compositions, and the like; polymers, thermoplastic polymers, engineered polymers, polymer blends, polymer alloys, polymer composites; materials compositions and composites containing dry lubricants, that include, for example, graphite, carbon, molybdenum, molybdenum disulfide, polytetrafluoroethylene, polyperfluoropropylene, polyperfluoroalkylethers, and the like.

Still further, the gear lubricant compositions of this disclosure provide advantaged lubricant viscosity and electrical conductivity control, including advantaged energy efficiency and durability performance in electric or hybrid vehicle gear components with the one or more lubricating oil base stocks having at least one Group IV base oil, or at least one Group V base oil, in accordance with this disclosure.

In an embodiment, the gear lubricating oils of this disclosure have an electrical conductivity from about 10 pS/m to less than about 15,000 pS/m, or from about 25 pS/m to about 12,000 pS/m, or from about 50 pS/m to about 10,000 pS/m, or from about 75 pS/m to about 9,000 pS/m, or from about 100 pS/m to about 8,000 pS/m, or from about 125 pS/m to about 7,000 pS/m, or from about 150 pS/m to about 6,000 pS/m, or from about 175 pS/m to about 5,000 pS/m, or from about 200 pS/m to about 4,000 pS/m, or from about 225 pS/m to about 3,500 pS/m, or from about 250 pS/m to about 3,000 pS/m, or from about 275 pS/m to about 2500 pS/m, or from about 300 pS/m to about 2000 pS/m, as determined by ASTM D-2624.

In an embodiment, the gear lubricating oils of this disclosure have a kinematic viscosity at 100° C. from about 1 cSt to about 7 cSt, or from about 1.25 cSt to about 5.5 cSt or from about 1.25 cSt to about 4.75 cSt, or from about 1.25 cSt to about 4.5 cSt, or from about 1.25 cSt to about 4.25 cSt, or from about 1.25 cSt to about 4 cSt, or from about 1.50 cSt to about 3.75 cSt, or from about 1.50 cSt to about 3.5 cSt, or from about 1.50 cSt to about 3.25 cSt, as determined by ASTM D-445.

In an embodiment, the gear lubricating oils of this disclosure have a coefficient of traction (CoT) of less than about 0.0350, or less than about 0.0300, or less than about 0.0250, or less than about 0.0200, or less than about 0.0150, or less than about 0.0100, as measured using a mini traction machine (MTM) at 80° C. and 1.25 GPa load at 100% slide to roll ratio (SRR).

In an embodiment, the gear lubricating oils of this disclosure have a durability performance passing at least stage 12, or at least stage 13 or greater, as determined by method DIN ISO 14635 (FZG Scuffing).

In an embodiment, the gear lubricating oils of this disclosure include one or more metals. A preferred metal is molybdenum. The metals content of the gear lubricating oils can be determined by ASTM 6376.

The gear lubricating oils of this disclosure are operable over a broad temperature range in gear components of electric or hybrid vehicles. The operating temperature performance range can be, for example, from about 25° C. to about 225° C. or greater, or from about 50° C. to about 200° C., or from about 75° C. to about 150° C., or from about 75° C. to about 100° C.

In an embodiment, the gear lubricating oils of this disclosure have at least about 90 weight percent of one or more lubricating oil base stocks; from about 0.01 to about 3 weight percent of one or more antioxidants; from about 0.01 to about 3 weight percent of one or more dispersants; from about 0.01 to about 2 weight percent of one or more antiwear agents; from about 0.01 to about 2 weight percent of one or more extreme pressure agents; and from about 0.01 to about 2 weight percent of one or more metals; in which each weight percent is based on the total weight of the gear lubricating oil.

The low viscosity gear lubricating oils can also serve as cooling fluids for electric and hybrid vehicles as well as mechanical and electrical systems, subsystems, and components for such vehicles.

Lubricating Oil Base Stocks and Cobase Stocks

A wide range of lubricating base oils is known in the art. Lubricating base oils that are useful in the present disclosure are natural oils, mineral oils and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad base oil stock categories developed and defined by the American Petroleum Institute (API Publication 1509; www.API.org) to create guidelines for lubricant base oils. Group I base stocks have a viscosity index of between about 80 to 120 and contain greater than about 0.03% sulfur and/or less than about 90% saturates. Group II base stocks have a viscosity index of between about 80 to 120, and contain less than or equal to about 0.03% sulfur and greater than or equal to about 90% saturates. Group III stocks have a viscosity index greater than about 120 and contain less than or equal to about 0.03% sulfur and greater than about 90% saturates. Group IV includes polyalphaolefins (PAO). Group V base stock includes base stocks not included in Groups I-IV. The table below summarizes properties of each of these five groups.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | polyalphaolefins (PAO) | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked base stocks, including synthetic oils such as alkyl aromatics and synthetic esters are also well known base stock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from about 250 to about 3,000, although PAO's may be made in viscosities up to about 150 cSt (100° C.). The PAOs are typically comprised of relatively low molecular weight hydrogenated polymers or oligomers of alphaolefins which include, but are not limited to, $C_2$ to about $C_{32}$ alphaolefins with the $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity base stocks of acceptably low volatility. Depending on the viscosity grade and the starting oligomer, the PAOs may be predominantly trimers and tetramers of the starting olefins, with minor amounts of the higher oligomers, having a viscosity range of 1.5 to 12 cSt. PAO fluids of particular use may include 3.0 cSt, 3.4 cSt, and/or 3.6 cSt and combinations thereof. Mixtures of PAO fluids having a viscosity range of 1.5 to approximately 150 cSt or more may be used if desired.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. Nos. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

Other PAOs useful in the present disclosure may have a kinematic viscosity at 100° C. from about 1.5 to about 5,000 cSt (mm2/s) For the purposes of this disclosure, these other PAOs preferably have a kinematic viscosity at 100° C. from about 2 to about 25 cSt (mm2/s), from about 2 to about 20 cSt, or from about 2 to about 15 cSt. PAOs are often identified by reference to their approximate kinematic viscosity at 100° C. For example, PAO 6 refers to a PAO with a kinematic viscosity of approximately 6 cSt at 100° C.

These other PAOs useful in the present disclosure can also be made by metallocene catalysis. The metallocene-catalyzed PAO (mPAO) can be a copolymer made from at least two or more different alphaolefins, or a homo-polymer made from a single alphaolefin feed employing a metallocene catalyst system.

The metallocene catalyst can be simple metallocenes, substituted metallocenes or bridged metallocene catalysts activated or promoted by, for instance, methylaluminoxane (MAO) or a non-coordinating anion, such as N,N-dimethylanilinium tetrakis(perfluorophenyl)borate or other equivalent non-coordinating anion. mPAO and methods for producing mPAO employing metallocene catalysis are described in WO 2007/011832 and U.S. published application 2009/0036725.

The copolymer mPAO composition is made from at least two alphaolefins of C2 to C30 range and having monomers randomly distributed in the polymers. It is preferred that the average carbon number is at least 4.1. Advantageously, ethylene and propylene, if present in the feed, are present in the amount of less than 50 wt % individually or preferably less than 50 wt % combined. The copolymers can be isotactic, atactic, syndiotactic polymers or any other form of appropriate taciticity.

mPAO can also be made from mixed feed linear alpha olefins (LAOs) comprising at least two and up to 26 different linear alphaolefins selected from $C_2$ to $C_{30}$ linear alphaolefins. The mixed feed LAO can be obtained, for example, from an ethylene growth processing using an aluminum catalyst or a metallocene catalyst. The growth olefins comprise mostly $C_6$ to $C_{18}$ LAO. LAOs from other processes can also be used.

The homopolymer mPAO composition can be made from single alphaolefin chosen from alphaolefins in the $C_2$ to $C_{30}$ range, preferably $C_2$ to $C_{16}$, most preferably $C_3$ to $C_{14}$ or $C_3$ to $C_{12}$. The homopolymers can be isotactic, atactic, syndiotactic polymers or any other form of appropriate taciticity. The taciticity can be carefully tailored by the polymerization catalyst and polymerization reaction condition chosen or by the hydrogenation condition chosen.

The alphaolefin(s) can be chosen also from any component from a conventional LAO production facility or from a refinery. It can be used alone to make homopolymer or together with another LAO available from a refinery or chemical plant, including propylene, 1-butene, 1-pentene, and the like, or with 1-hexene or 1-octene made from a dedicated production facility. The alphaolefins also can be chosen from the alphaolefins produced from Fischer-Tropsch synthesis (as reported in U.S. Pat. No. 5,382,739). For example, $C_2$ to $C_{16}$ alphaolefins, more preferably linear alphaolefins, are suitable to make homo-polymers. Other combinations, such as $C_4$ and $C_{14}$-LAO, $C_6$- and $C_{16}$-LAO, $C_8$-, $C_{10}$-, $C_{12}$-LAO, or $C_8$-and $C_{14}$-LAO, $C_6$-, $C_{10}$-, $C_{14}$-LAO, $C_4$ and $C_{12}$-LAO, etc., are suitable to make copolymers.

A feed comprising a mixture of LAOs selected from $C_2$ to $C_{30}$ LAOs or a single LAO selected from $C_2$ to $C_{16}$ LAO, is contacted with an activated metallocene catalyst under oligomerization conditions to provide a liquid product suitable for use in lubricant components or as functional fluids. Also embraced are copolymer compositions made from at least two alphaolefins of $C_2$ to $C_{30}$ range and having monomers randomly distributed in the polymers. The phrase "at least two alphaolefins" will be understood to mean "at least two different alphaolefins" (and similarly "at least three alphaolefins" means "at least three different alphaolefins", and so forth).

The product obtained is an essentially random liquid copolymer comprising the at least two alphaolefins. By "essentially random" is meant that one of ordinary skill in the art would consider the products to be random copolymer. Likewise the term "liquid" will be understood by one of ordinary skill in the art as meaning liquid under ordinary conditions of temperature and pressure, such as ambient temperature and pressure.

Illustrative other PAOs useful in this disclosure are described, for example, in U.S. Application Publication No. 2013/0005633, the disclosure of which is incorporated herein by reference.

Other useful lubricant oil base stocks include wax isomerate base stocks and base oils, comprising hydroisomerized waxy stocks (e.g. waxy stocks such as gas oils, slack waxes, fuels hydrocracker bottoms, etc.), hydroisomerized Fischer-Tropsch waxes, Gas-to-Liquids (GTL) base stocks and base oils, and other wax isomerate hydroisomerized base stocks and base oils, or mixtures thereof. Fischer-Tropsch waxes, the high boiling point residues of Fischer-Tropsch synthesis, are highly paraffinic hydrocarbons with very low sulfur content. The hydroprocessing used for the production of such base stocks may use an amorphous hydrocracking/hydroisomerization catalyst, such as one of the specialized lube hydrocracking (LHDC) catalysts or a crystalline hydrocracking/hydroisomerization catalyst, preferably a zeolitic catalyst. For example, one useful catalyst is ZSM-48 as described in U.S. Pat. No. 5,075,269, the disclosure of which is incorporated herein by reference in its entirety. Processes for making hydrocracked/hydroisomerized distillates and hydrocracked/hydroisomerized waxes are described, for example, in U.S. Pat. Nos. 2,817,693; 4,975,177; 4,921,594 and 4,897,178 as well as in British Patent Nos. 1,429,494; 1,350,257; 1,440,230 and 1,390,359. Each of the aforementioned patents is incorporated herein in their entirety. Particularly favorable processes are described in European Patent Application Nos. 464546 and 464547, also incorporated herein by reference. Processes using Fischer-Tropsch wax feeds are described in U.S. Pat. Nos. 4,594,172 and 4,943,672, the disclosures of which are incorporated herein by reference in their entirety.

Gas-to-Liquids (GTL) base oils, Fischer-Tropsch wax derived base oils, and other wax-derived hydroisomerized (wax isomerate) base oils be advantageously used in the instant disclosure, and may have useful kinematic viscosities at 100° C. of about 3 cSt to about 50 cSt, preferably about 3 cSt to about 30 cSt, more preferably about 3.5 cSt to about 25 cSt, as exemplified by GTL 4 with kinematic viscosity of about 4.0 cSt at 100° C. and a viscosity index of about 141. These Gas-to-Liquids (GTL) base oils, Fischer-Tropsch wax derived base oils, and other wax-derived hydroisomerized base oils may have useful pour points of about −20° C. or lower, and under some conditions may have advantageous pour points of about −25° C. or lower, with useful pour points of about −30° C. to about −40° C. or lower. Useful compositions of Gas-to-Liquids (GTL) base oils, Fischer-Tropsch wax derived base oils, and wax-derived hydroisomerized base oils are recited in U.S. Pat. Nos. 6,080,301; 6,090,989, and 6,165,949 for example, and are incorporated herein in their entirety by reference.

The hydrocarbyl aromatics can be used as a base oil or base oil component and can be any hydrocarbyl molecule that contains at least about 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from about $C_6$ up to about $C_{60}$ with a range of about $C_8$ to about $C_{20}$ often being preferred. A mixture of hydrocarbyl groups is often preferred, and up to about three such substituents may be present. The hydrocarbyl group can optionally contain sulfur, oxygen, and/or nitrogen containing substituents. The aromatic group can also be derived from natural (petroleum) sources, provided at least about 5% of the molecule is comprised of an above-type aromatic moiety. Viscosities at 100° C. of approximately 3 cSt to about 50 cSt are preferred, with viscosities of approximately 3.4 cSt to about 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be about 2% to about 25%, preferably about 4% to about 20%, and more preferably about 4% to about 15%, depending on the application.

Alkylated aromatics such as the hydrocarbyl aromatics of the present disclosure may be produced by well-known Friedel-Crafts alkylation of aromatic compounds. See Friedel-Crafts and Related Reactions, Olah, G. A. (ed.), Interscience Publishers, New York, 1963. For example, an aromatic compound, such as benzene or naphthalene, is alkylated by an olefin, alkyl halide or alcohol in the presence of a Friedel-Crafts catalyst. See Friedel-Crafts and Related Reactions, Vol. 2, part 1, chapters 14, 17, and 18, See Olah, G. A. (ed.), Inter-science Publishers, New York, 1964. Many homogeneous or heterogeneous, solid catalysts are known to one skilled in the art. The choice of catalyst depends on the reactivity of the starting materials and product quality requirements. For example, strong acids such as $AlCl_3$, $BF_3$, or HF may be used. In some cases, milder catalysts such as $FeCl_3$ or $SnCl_4$ are preferred. Newer alkylation technology uses zeolites or solid super acids.

Esters comprise a useful base stock. Additive solvency and seal compatibility characteristics may be secured by the use of esters such as the esters of monocarboxylic acids with monoalkanols, dibasic acids with monoalkanols and the polyol esters of monocarboxylic acids. Esters of the monocarboxylic acid such as linear or branched hexanoic acid, linear or branched heptanoic acid, linear or branched octanoic acid, linear or branched nonanoic acid, linear or branched decanoic acid, linear or branched undecanoic acid, linear or branched dodecanoic acid, linear or branched tridecanoic acid, linear or branched tetradecanoic acid, linear or branched pentadecanoic acid, linear or branched hexanoic acid, etc. with a variety of alcohols such as linear or branched butyl alcohol, linear or branched amyl alcohol, linear or branched hexyl alcohol, linear or branched heptyl alcohol, linear or branched octyl alcohol, linear or branched nonyl alcohol, linear or branched decyl alcohol, etc. Specific examples of these types of esters include octyl octanoate, iso-amyl dodecanoate, and 2-ethylhexyl dodecanoate. Also, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, and the like. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, and the like.

Another family of useful synthetic esters are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least about 4 carbon atoms, preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms. These esters are widely available commercially, for example, the Mobil P-41 and P-51 esters of ExxonMobil Chemical Company.

Also useful are esters derived from renewable material such as coconut, palm, rapeseed, soy, sunflower and the like. These esters may be monoesters, di-esters, polyol esters, complex esters, or mixtures thereof. These esters are widely available commercially, for example, the Mobil P-51 ester of ExxonMobil Chemical Company.

Gear oil formulations containing renewable esters are included in this disclosure. For such formulations, the renewable content of the ester is typically greater than about 70 weight percent, preferably more than about 80 weight percent and most preferably more than about 90 weight percent.

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from about 2 $mm^2/s$ to about 50 $mm^2/s$ (ASTM D445). They are further characterized typically as having pour points of −5° C. to about −40° C. or lower (ASTM D97). They are also characterized typically as having viscosity indices of about 80 to about 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorous and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

Other lubricating oils useful in the present disclosure are oil soluble polyalkylene glycols (PAGs). The oil soluble PAGs are selected from alcohol initiated butylene oxide homopolymers and alcohol initiated copolymers of butylene oxide and propylene oxide. Preferably, the oil soluble PAG is one or more than one alcohol initiated copolymer of butylene oxide and propylene oxide. The copolymer can be a random copolymer or a block copolymer. When a block copolymer, the butylene oxide and propylene oxide can be polymerized in either order to form a propylene oxide/butylene oxide or a butylene oxide/propylene oxide block copolymer extending off from the alcohol initiator, where propylene oxide is the ring opened (polymerized) propylene oxide component and butylene oxide is the ring opened (polymerized) butylene oxide component left after polymerization. Desirably, the oil soluble PAG is an alcohol initiated propylene oxide/butylene oxide random copolymer. The amount of butylene oxide is desirably 40 weight-percent (wt %) or more, preferably 50 wt % or more and can be 60 wt % or more, 65 wt % or more and even 70 wt % or more and at the same time is typically 80 wt % or less and can be 70 wt % or less based on the total weight of propylene oxide and butylene oxide. Desirably, the oil soluble PAG is 50 wt % propylene oxide and 50 wt % butylene oxide based on total weight of propylene oxide and butylene oxide (that is, propylene oxide and butylene oxide are copolymerized at a 50/50 weight ratio).

The oil soluble PAGs are desirably prepared from an alcohol initiator having 8 carbons or more, preferably 10 carbons or more, still more preferably 12 carbons or more, more preferably 14 carbons or more and can be 16 carbons or more and even 18 carbons or more while at the same time typically having 20 carbons or fewer. At the same time, the initiator is desirably linear and more preferably a primary alcohol. One particularly desirable alcohol initiator for preparing the oil soluble PAGs is dodecanol.

The alcohol initiator for the oil soluble PAGs can be a monol, diol or triol. Preferably, the alcohol initiator is a monol.

The oil soluble PAGs can be terminated with a hydrogen (H) to form a terminal alcohol (hydroxyl) linkage or can be capped with a group other than hydrogen, preferably to a carbon atom, to form linkages such as those selected from ethers and esters. The termination linkage is on the opposite end of the oil soluble PAGs from the alcohol initiator.

The oil soluble PAGs generally have a kinematic viscosity at 40° C. of 15 cSt or higher, preferably 18 cSt or higher, more preferably 32 cSt or higher, and can be 68 cSt or higher, 80 cSt or higher, 100 cSt or higher, 150 cSt or higher and even 220 cSt or higher while at the same time is generally 250 cSt or lower. Determine kinematic viscosity according to ASTM D445.

The oil soluble PAGs generally have an average molecular weight of 500 grams per mole (g/mol) or more, preferably 750 g/mol or more, and can be 1000 g/mol or more, 1250 g/mol or more, 1500 g/mol or more, 1900 g/mol or more, or 2400 g/mol or more and at the same time is generally 3600 g/mol or less, preferably 2400 g/mol or less and more preferably 1900 g/mol or less and even more preferably 1400 g/mol or less and most preferably less than 1400 g/mol. Determine average molecular weight according by gel permeation chromatography. Unless otherwise indicated, "molecular weight" refers to number average molecular weight (Mn).

The concentration of oil soluble PAGs is generally 2 wt % or more, preferably 5 wt % or more and can be 10 wt % or more, 15 wt % or more and even 20 wt % or more while at the same time is typically 30 wt % or less, and generally 25 wt % or less or even 20 wt % or less based on total lubricant weight.

Illustrative oil soluble PAGs useful in this disclosure are described, for example, in U.S. Application Publication No. 2017/0073611, the disclosure of which is incorporated herein by reference.

Other lubricating oils useful in the present disclosure are polytetrahydrofuran, polytetrahydrofuran copolymers or diesters or monoesters of these polymers. Polytetrahydrofuran ("PTHF") is also known as poly(oxybutylene glycol).

Illustrative polytetrahydrofuran, polytetrahydrofuran copolymers or diesters or monoesters of these polymers are described, for example, in U.S. Pat. Nos. 6,455,711 and 7,041,752, the disclosures of which are incorporated herein by reference.

Base oils for use in the formulated lubricating oils useful in the present disclosure are any of the variety of oils corresponding to API Group I, Group II, Group III, Group IV, and Group V oils, and mixtures thereof, preferably API Group II, Group III, Group IV, and Group V oils, and mixtures thereof, more preferably Group III, Group IV, and Group V base oils, and mixtures thereof. Highly paraffinic base oils can be used to advantage in the formulated lubricating oils useful in the present disclosure. Minor quantities of Group I stock, such as the amount used to dilute additives for blending into formulated lube oil products, can also be used. Even in regard to the Group II stocks, it is preferred that the Group II stock be in the higher quality range associated with that stock, i.e. a Group II stock having a viscosity index in the range 100<VI<120.

The base oil constitutes the major component of the engine oil lubricant composition of the present disclosure and typically is present in an amount ranging from about 50 to about 99 weight percent, preferably from about 70 to about 95 weight percent, and more preferably from about 85 to about 95 weight percent, based on the total weight of the composition. The base oil may be selected from any of the synthetic or natural oils typically used as crankcase lubricating oils for spark-ignited and compression-ignited engines. The base oil conveniently has a kinematic viscosity, according to ASTM standards, of about 2.5 cSt to about 12 cSt (or $mm^2/s$) at 100° C. and preferably of about 2.5 cSt to about 9 cSt (or $mm^2/s$) at 100° C. Mixtures of synthetic and natural base oils may be used if desired. Bi-modal mixtures of Group I, II, III, IV, and/or V base stocks may be used if desired.

Lubricating Oil Additives

The formulated lubricating oil useful in the present disclosure may contain one or more of the commonly used lubricating oil performance additives including but not limited to antioxidants, dispersants, antiwear agents, extreme pressure additives, ionic liquids, anti-seizure agents, wax modifiers, fluid-loss additives, seal compatibility agents, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973); see also U.S. Pat. No. 7,704,930, the disclosure of which is incorporated herein in its entirety. These additives are commonly delivered with varying amounts of diluent oil, that may range from 5 weight percent to 50 weight percent.

The additives useful in this disclosure do not have to be soluble in the lubricating oils. Insoluble additives such as zinc stearate in oil can be dispersed in the lubricating oils of this disclosure.

The types and quantities of performance additives used in combination with the instant disclosure in lubricant compositions are not limited by the examples shown herein as illustrations.

Antioxidants

The lubricating oil compositions include at least one antioxidant. Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Illustrative antioxidants include sterically hindered alkyl phenols such as 2,6-di-tert-butylphenol, 2,6-di-tert-butyl-p-cresol and 2,6-di-tert-butyl-4-(2-octyl-3-propanoic) phenol; N,N-di(alkylphenyl) amines; and alkylated phenylenediamines.

The antioxidant may be a hindered phenolic antioxidant such as butylated hydroxytoluene, suitably present in an amount of 0.01 to 5%, preferably 0.4 to 0.8%, by weight of the lubricant composition. Alternatively, or in addition, the antioxidant may comprise an aromatic amine antioxidant such as mono-octylphenylalphanapthyl amine or p,p-dioctyldiphenylamine, used singly or in admixture. The amine antioxidant component is suitably present in a range of from 0.01 to 5% by weight of the lubricant composition, more preferably 0.5 to 1.5%.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant disclosure. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Other illustrative phenolic antioxidants include sulfurized and non-sulfurized phenolic antioxidants. The terms "phenolic type" or "phenolic antioxidant" used herein includes compounds having one or more than one hydroxyl group bound to an aromatic ring which may itself be mononuclear, e.g., benzyl, or poly-nuclear, e.g., naphthyl and Spiro aromatic compounds. Thus "phenol type" includes phenol per se, catechol, resorcinol, hydroquinone, naphthol, etc., as well as alkyl or alkenyl and sulfurized alkyl or alkenyl derivatives thereof, and bisphenol type compounds including such bi-phenol compounds linked by alkylene bridges sulfuric bridges or oxygen bridges. Alkyl phenols include mono- and poly-alkyl or alkenyl phenols, the alkyl or alkenyl group containing from 3-100 carbons, preferably 4 to 50 carbons and sulfurized derivatives thereof, the number of alkyl or alkenyl groups present in the aromatic ring ranging from 1 to up to the available unsatisfied valences of the aromatic ring remaining after counting the number of hydroxyl groups bound to the aromatic ring.

Generally, therefore, the phenolic antioxidant may be represented by the general formula:

$$(R)_x—Ar—(OH)_y$$

where Ar is selected from the group consisting of:

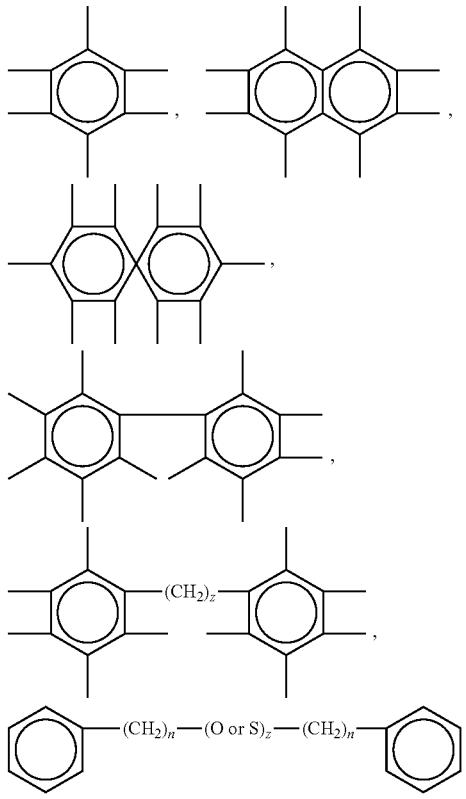

-continued

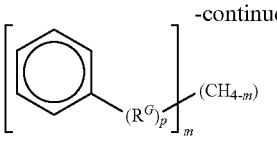

wherein R is a $C_3$-$C_{100}$ alkyl or alkenyl group, a sulfur substituted alkyl or alkenyl group, preferably a $C_4$-$C_{50}$ alkyl or alkenyl group or sulfur substituted alkyl or alkenyl group, more preferably $C_3$-$C_{100}$ alkyl or sulfur substituted alkyl group, most preferably a $C_4$-$C_{50}$ alkyl group, $R^g$ is a $C_1$-$C_{100}$ alkylene or sulfur substituted alkylene group, preferably a $C_2$-$C_{50}$ alkylene or sulfur substituted alkylene group, more preferably a $C_2$-$C_{20}$ alkylene or sulfur substituted alkylene group, y is at least 1 to up to the available valences of Ar, x ranges from 0 to up to the available valances of Ar-y, z ranges from 1 to 10, n ranges from 0 to 20, and m is 0 to 4 and p is 0 or 1, preferably y ranges from 1 to 3, x ranges from 0 to 3, z ranges from 1 to 4 and n ranges from 0 to 5, and p is 0.

Preferred phenolic antioxidant compounds are the hindered phenolics and phenolic esters which contain a sterically hindered hydroxyl group, and these include those derivatives of dihydroxy aryl compounds in which the hydroxyl groups are in the o- or p-position to each other. Typical phenolic antioxidants include the hindered phenols substituted with C.sub.1+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; 2-methyl-6-t-butyl-4-dodecyl phenol; 2,6-di-t-butyl-4 methyl phenol; 2,6-di-t-butyl-4-ethyl phenol; and 2,6-di-t-butyl 4 alkoxy phenol; and

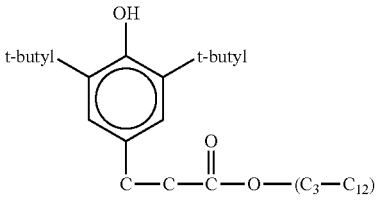

Phenolic type antioxidants are well known in the lubricating industry and commercial examples such as Ethanox™ 1710, Irganox™ 1076, Irganox™ L1035, Irganox™ 1010, Irganox™ L109, Irganox™ L118, Irganox™ L135 and the like are familiar to those skilled in the art. The above is presented only by way of exemplification, not limitation on the type of phenolic antioxidants which can be used.

Other examples of phenol-based antioxidants include 2-t-butylphenol, 2-t-butyl-4-methylphenol, 2-t-butyl-5-methylphenol, 2,4-di-t-butylphenol, 2,4-dimethyl-6-t-butylphenol, 2-t-butyl-4-methoxyphenol, 3-t-butyl-4-methoxyphenol, 2,5-di-t-butylhydroquinone (manufactured by the Kawaguchi Kagaku Co. under trade designation "Antage DBH"), 2,6-di-t-butylphenol and 2,6-di-t-butyl-4-alkylphenols such as 2,6-di-t-butyl-4-methylphenol and 2,6-di-t-butyl-4-ethylphenol; 2,6-di-t-butyl-4-alkoxyphenols such as 2,6-di-t-butyl-4-methoxyphenol and 2,6-di-t-butyl-4-ethoxyphenol, 3,5-di-t-butyl-4-hydroxybenzylmercaptoocty-1 acetate, alkyl-3-(3,5-di-t-butyl-4-hydroxyphenyl) propionates such as n-octyl-3-(3,5-di-t-butyl-4-hydroxyphenyl)propionate (manufactured by the Yoshitomi Seiyaku Co. under the trade designation "Yonox SS"), n-dodecyl-3-(3,5-di-t-butyl-4-hydroxyphenyl)propionate and 2'-ethylhexyl-3-(3,5-di-t-butyl-4-hydroxyphenyl)propionate; 2,6-di-t-butyl-alpha-dimethylamino-p-cresol, 2,2'-methylenebis(4-alkyl-6-t-butylphenol) compounds such as 2,2'-methylenebis(4-methyl-6-t-butylphe-nol) (manufactured by the Kawaguchi Kagaku Co. under the trade designation "Antage W-400") and 2,2'-methylenebis(4-ethyl-6-t-butylphenol) (manufactured by the Kawaguchi Kagaku Co. under the trade designation "Antage W-500"); bisphenols such as 4,4'-butylidenebis(3-methyl-6-t-butyl-phenol) (manufactured by the Kawaguchi Kagaku Co. under the trade designation "Antage W-300"), 4,4'-methylenebis(2,6-di-t-butylphenol) (manufactured by Laporte Performance Chemicals under the trade designation "Ionox 220AH"), 4,4'-bis(2,6-di-t-butylphenol), 2,2-(di-p-hydroxyphenyl) propane (Bisphenol A), 2,2-bis(3,5-di-t-butyl-4-hydroxyphenyl)propane, 4,4'-cyclohexylidenebis(2,6-di-t-butylphenol), hexamethylene glycol bis[3, (3,5-di-t-butyl-4-hydroxyphenyl)propionate] (manufactured by the Ciba Speciality Chemicals Co. under the trade designation "Irganox L109"), triethylene glycol bis[3-(3-t-butyl-4-hydroxy-y-5-methylphenyl)propionate] (manufactured by the Yoshitomi Seiyaku Co. under the trade designation "Tominox 917"), 2,2'-thio[diethyl-3-(3,5-di-t-butyl-4-hydroxyphenyl)propionate] (manufactured by the Ciba Speciality Chemicals Co. under the trade designation "Irganox L115"), 3,9-bis{1,1-dimethyl-2-[3-(3-t-butyl-4-hydroxy-5-methylphenyl)-propionyloxy]ethyl}2,4,8,10-tetraoxaspiro[5,5] undecane (manufactured by the Sumitomo Kagaku Co. under the trade designation "Sumilizer GA80") and 4,4'-thiobis(3-methyl-6-t-butylphenol) (manufactured by the Kawaguchi Kagaku Co. under the trade designation "Antage RC"), 2,2'-thiobis(4,6-di-t-butylresorcinol); polyphenols such as tetrakis[methylene-3-(3,5-di-t-butyl-4-hydroxyphenyl)propionato[methane (manufactured by the Ciba Speciality Chemicals Co. under the trade designation "Irganox L101"), 1,1,3-tris(2-methyl-4-hydroxy-5-t-butylpheny-l)butane (manufactured by the Yoshitomi Seiyaku Co. under the trade designation "Yoshinox 930"), 1,3,5-trimethyl-2,4,6-tris(3,5-di-t-butyl-4-hydroxybenzyl)benzene (manufactured by Ciba Speciality Chemicals under the trade designation "Irganox 330"), bis[3,3'-bis(4'-hydroxy-3'-t-butylpheny-l) butyric acid] glycol ester, 2-(3',5'-di-t-butyl-4-hydroxyphenyl)-methyl-4-(2",4"-di-t-butyl-3"-hyd-roxyphenyl)methyl-6-t-butylphenol and 2,6-bis(2'-hydroxy-3'-t-butyl-5'-methylbenzyl)-4-methylphenol; and phenol/aldehyde condensates such as the condensates of p-t-butylphenol and formaldehyde and the condensates of p-t-butylphenol and acetaldehyde.

Effective amounts of one or more catalytic antioxidants may also be used. The catalytic antioxidants comprise an effective amount of a) one or more oil soluble polymetal organic compounds; and, effective amounts of b) one or more substituted N,N'-diaryl-o-phenylenediamine compounds or c) one or more hindered phenol compounds; or a combination of both b) and c). Catalytic antioxidants are more fully described in U.S. Pat. No. 8,048,833, herein incorporated by reference in its entirety.

Illustrative aromatic amine antioxidants include phenyl-alpha-naphthyl amine which is described by the following molecular structure:

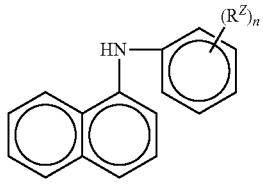

wherein $R^z$ is hydrogen or a $C_1$ to $C_{14}$ linear or $C_3$ to $C_{14}$ branched alkyl group, preferably $C_1$ to $C_{10}$ linear or $C_3$ to $C_{10}$ branched alkyl group, more preferably linear or branched $C_6$ to $C_8$ and n is an integer ranging from 1 to 5 preferably 1. A particular example is Irganox L06.

Other aromatic amine antioxidants include other alkylated and non-alkylated aromatic amines such as aromatic monoamines.

Typical aromatic amines antioxidants have alkyl substituent groups of at least 6 carbon atoms. Examples of aliphatic groups include hexyl, heptyl, octyl, nonyl, and decyl. Generally, the aliphatic groups will not contain more than 14 carbon atoms. The general types of such other additional amine antioxidants which may be present include diphenylamines, phenothiazines, imidodibenzyls and diphenyl phenylene diamines. Mixtures of two or more of such other additional aromatic amines may also be present. Polymeric amine antioxidants can also be used.

The antioxidants or oxidation inhibitors that are useful in lubricant oil compositions of the disclosure are the hindered phenols (e.g., 2,6-di-(t-butyl)phenol); aromatic amines (e.g., alkylated diphenyl amines); alkyl polysulfides; selenides; borates (e.g., epoxide/boric acid reaction products); phosphorodithioic acids, esters and/or salts; and the dithiocarbamate (e.g., zinc dithiocarbamates). In an embodiment, these antioxidants or oxidation inhibitors can be employed at ratios of amine/phenolic from 1:10 to 10:1 of the mixtures preferred.

The antioxidants or oxidation inhibitors that are also useful in lubricant oil compositions of the disclosure are chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfiirized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)(phosphorodithioate, cadmium dinonylphosphorodithioate, and the reaction of phosphorus pentasulfide with an equimolar mixture of isopropyl alcohol, 4-methyl-2-pentanol, and n-hexyl alcohol.

Oxidation inhibitors including organic compounds containing sulfur, nitrogen, phosphorus and some alkylphenols are useful additives in the lubricating oil formulations of this disclosure. Two general types of oxidation inhibitors are those that react with the initiators, peroxy radicals, and hydroperoxides to form inactive compounds, and those that decompose these materials to form less active compounds. Examples are hindered (alkylated) phenols, e.g. 6-di(tert-butyl)-4-methyl-phenol[2,6-di(tert-butyl)-p-cresol, DBPC], and aromatic amines, e.g. N-phenyl-alpha-naphthalamine.

Sulfurized alkyl phenols and alkali or alkaline earth metal salts thereof also are useful antioxidants.

Another class of antioxidant used in lubricating oil compositions and which may also be present are oil-soluble copper compounds. Any oil-soluble suitable copper compound may be blended into the lubricating oil. Examples of suitable copper antioxidants include copper dihydrocarbyl thio- or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are known to be particularly useful.

A sulfur-containing antioxidant may be any and every antioxidant containing sulfur, for example, including dialkyl thiodipropionates such as dilauryl thiodipropionate and distearyl thiodipropionate, dialkyldithiocarbamic acid derivatives (excluding metal salts), bis(3,5-di-t-butyl-4-hydroxybenzyl)sulfide, mercaptobenzothiazole, reaction products of phosphorus pentoxide and olefins, and dicetyl sulfide. Of these, preferred are dialkyl thiodipropionates such as dilauryl thiodipropionate and distearyl thiodipropionate. The amine-type antioxidant includes, for example, monoalkyldiphenylamines such as monooctyldiphenylamine and monononyldiphenyl amine; dialkyldiphenylamines such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamines such as tetrabutyldiphenylamine, tetrahexyldiphenylamine, tetraoctyldiphenylamine and tetranonyldiphenylamine; and naphthylamines such as alpha-naphthylamine, phenyl-alpha-naphthylamine, butylphenyl-alpha-naphthylamine, pentylphenyl-alpha-naphthylamine, hexylphenyl-alpha-naphthylamine, heptylphenyl-alpha-naphthylamine, octylphenyl-alpha-naphthyl amine and nonylphenyl-alpha-naphthylamine Of these, preferred are dialkyldiphenylamines.

Examples of sulphur-based antioxidants include dialkylsulphides such as didodecylsulphide and dioctadecylsulphide; thiodipropionic acid esters such as didodecyl thiodipropionate, dioctadecyl thiodipropionate, dimyristyl thiodipropionate and dodecyloctadecyl thiodipropionate, and 2-mercaptobenzimidazole.

Such antioxidants may be used individually or as mixtures of one or more types of antioxidants, the total amount employed being an amount of about 0.01 to about 5 wt %, preferably 0.1 to about 4.5 wt %, more preferably 0.25 to 3 wt % (on an as-received basis).

Dispersants

The lubricating oil compositions include at least one dispersant. During engine operation, oil-insoluble oxidation byproducts are produced. Dispersants help keep these byproducts in solution, thus diminishing their deposition on metal surfaces. Dispersants used in the formulation of the lubricating oil may be ashless or ash-forming in nature. Preferably, the dispersant is ashless. So called ashless dispersants are organic materials that form substantially no ash upon combustion. For example, non-metal-containing or borated metal-free dispersants are considered ashless.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the (poly) alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between hydrocarbyl substituted succinic anhydrides and amines. Molar ratios can vary depending on the polyamine. For example, the molar ratio of hydrocarbyl substituted succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800.

Succinate esters are formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides are formed by condensation reaction between hydrocarbyl substituted succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the hydrocarbyl substituted succinic anhydrides used in the preceding paragraphs will typically range between 800 and 2,500 or more. The above products can be post-reacted with various reagents such as sulfur, oxygen, formaldehyde, carboxylic acids such as oleic acid. The above products can also be post reacted with boron compounds such as boric acid, borate esters or highly borated dispersants, to form borated dispersants generally having from about 0.1 to about 5 moles of boron per mole of dispersant reaction product.

Mannich base dispersants are made from the reaction of alkylphenols, formaldehyde, and amines See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this disclosure can be prepared from high molecular weight alkyl-substituted hydroxyaromatics or $HNR_2$ group-containing reactants.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Illustrative dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000, or from about 1000 to about 3000, or about 1000 to about 2000, or a mixture of such hydrocarbylene groups, often with high terminal vinylic groups. Other preferred dispersants include succinic acid-esters and amides, alkylphenol-polyamine-coupled Mannich adducts, their capped derivatives, and other related components.

Polymethacrylate or polyacrylate derivatives are another class of dispersants. These dispersants are typically prepared by reacting a nitrogen containing monomer and a methacrylic or acrylic acid esters containing 5-25 carbon atoms in the ester group. Representative examples are shown in U.S. Pat. Nos. 2,100,993, and 6,323,164. Polymethacrylate and polyacrylate dispersants are normally used as multifunctional viscosity modifiers. The lower molecular weight versions can be used as lubricant dispersants or fuel detergents.

Other illustrative dispersants useful in this disclosure include those derived from polyalkenyl-substituted mono- or dicarboxylic acid, anhydride or ester, which dispersant has a polyalkenyl moiety with a number average molecular weight of at least 900 and from greater than 1.3 to 1.7, preferably from greater than 1.3 to 1.6, most preferably from greater than 1.3 to 1.5, functional groups (mono- or dicarboxylic acid producing moieties) per polyalkenyl moiety (a medium functionality dispersant). Functionality (F) can be determined according to the following formula:

$$F=(SAP\times M_n)/((112{,}200\times A.I.)-(SAP\times 98))$$

wherein SAP is the saponification number (i.e., the number of milligrams of KOH consumed in the complete neutralization of the acid groups in one gram of the succinic-containing reaction product, as determined according to ASTM D94); $M_n$ is the number average molecular weight of the starting olefin polymer; and A.I. is the percent active ingredient of the succinic-containing reaction product (the remainder being unreacted olefin polymer, succinic anhydride and diluent).

The polyalkenyl moiety of the dispersant may have a number average molecular weight of at least 900, suitably at least 1500, preferably between 1800 and 3000, such as between 2000 and 2800, more preferably from about 2100 to 2500, and most preferably from about 2200 to about 2400. The molecular weight of a dispersant is generally expressed in terms of the molecular weight of the polyalkenyl moiety. This is because the precise molecular weight range of the dispersant depends on numerous parameters including the type of polymer used to derive the dispersant, the number of functional groups, and the type of nucleophilic group employed.

Polymer molecular weight, specifically $M_n$, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method for determining molecular weight, particularly for lower molecular weight polymers, is vapor pressure osmometry (e.g., ASTM D3592).

The polyalkenyl moiety in a dispersant preferably has a narrow molecular weight distribution (MWD), also referred to as polydispersity, as determined by the ratio of weight average molecular weight ($M_w$) to number average molecular weight ($M_n$). Polymers having a $M_w/M_n$ of less than 2.2, preferably less than 2.0, are most desirable. Suitable polymers have a polydispersity of from about 1.5 to 2.1, preferably from about 1.6 to about 1.8.

Suitable polyalkenes employed in the formation of the dispersants include homopolymers, interpolymers or lower molecular weight hydrocarbons. One family of such polymers comprise polymers of ethylene and/or at least one $C_3$ to $C_{24}$ alpha-olefin. Preferably, such polymers comprise interpolymers of ethylene and at least one alpha-olefin of the above formula.

Another useful class of polymers is polymers prepared by cationic polymerization of monomers such as isobutene and styrene. Common polymers from this class include polyisobutenes obtained by polymerization of a $C_4$ refinery stream having a butene content of 35 to 75% by wt., and an isobutene content of 30 to 60% by wt. A preferred source of monomer for making poly-n-butenes is petroleum feedstreams such as Raffinate II. These feedstocks are disclosed in the art such as in U.S. Pat. No. 4,952,739. A preferred embodiment utilizes polyisobutylene prepared from a pure isobutylene stream or a Raffinate I stream to prepare reactive isobutylene polymers with terminal vinylidene olefins. Polyisobutene polymers that may be employed are generally based on a polymer chain of from 1500 to 3000.

Dispersants that contain the alkenyl or alkyl group have an Mn value of about 500 to about 5000 and an Mw/Mn ratio of about 1 to about 5. The preferred Mn intervals depend on the chemical nature of the agent improving filterability. Polyolefinic polymers suitable for the reaction with maleic anhydride or other acid materials or acid forming materials, include polymers containing a predominant quantity of $C_2$ to $C_5$ monoolefins, for example, ethylene, propylene, butylene, isobutylene and pentene. A highly suitable polyolefinic polymer is polyisobutene. The succinic anhydride preferred as a reaction substance is PIBSA, that is, polyisobutenyl succinic anhydride.

If the dispersant contains a succinimide comprising the reaction product of a succinic anhydride with a polyamine, the alkenyl or alkyl substituent of the succinic anhydride serving as the reaction substance consists preferably of polymerised isobutene having an Mn value of about 1200 to about 2500. More advantageously, the alkenyl or alkyl substituent of the succinic anhydride serving as the reaction substance consists in a polymerised isobutene having an Mn value of about 2100 to about 2400. If the agent improving filterability contains an ester of succinic acid comprising the reaction product of a succinic anhydride and an aliphatic polyhydric alcohol, the alkenyl or alkyl substituent of the succinic anhydride serving as the reaction substance consists advantageously of a polymerised isobutene having an Mn value of 500 to 1500. In preference, a polymerised isobutene having an Mn value of 850 to 1200 is used.

The amides may be amides of mono- or polycarboxylic acids or reactive derivatives thereof. The amides may be characterized by a hydrocarbyl group containing from about 6 to about 90 carbon atoms; each is independently hydrogen or a hydrocarbyl, aminohydrocarbyl, hydroxyhydrocarbyl or a heterocyclic-substituted hydrocarbyl group, provided that both are not hydrogen; each is, independently, a hydrocarbylene group containing up to about 10 carbon atoms.

The amide can be derived from a monocarboxylic acid, a hydrocarbyl group containing from 6 to about 30 or 38 carbon atoms and more often will be a hydrocarbyl group derived from a fatty acid containing from 12 to about 24 carbon atoms.

An illustrative amide that is derived from a di- or tricarboxylic acid, will contain from 6 to about 90 or more carbon atoms depending on the type of polycarboxylic acid. For example, when the amide is derived from a dimer acid, will contain from about 18 to about 44 carbon atoms or more, and amides derived from trimer acids generally will contain an average of from about 44 to about 90 carbon atoms. Each is independently hydrogen or a hydrocarbyl, aminohydrocarbyl, hydroxyhydrocarbyl or a heterocyclic-substituted hydrocarbon group containing up to about 10 carbon atoms. It may be independently heterocyclic substituted hydrocarbyl groups wherein the heterocyclic substituent is derived from pyrrole, pyrroline, pyrrolidine, morpholine, piperazine, piperidine, pyridine, pipecoline, etc. Specific examples include methyl, ethyl, n-propyl, n-butyl, n-hexyl, hydroxymethyl, hydroxyethyl, hydroxypropyl, amino-methyl, aminoethyl, aminopropyl, 2-ethylpyridine, 1-ethylpyrrolidine, 1-ethylpiperidine, etc.

Illustrative aliphatic monoamines include mono-aliphatic and di-aliphatic-substituted amines wherein the aliphatic groups may be saturated or unsaturated and straight chain or branched chain. Such amines include, for example, mono- and di-alkyl-substituted amines, mono- and dialkenyl-substituted amines, etc. Specific examples of such monoamines include ethyl amine, diethyl amine, n-butyl amine, di-n-butyl amine, isobutyl amine, coco amine, stearyl amine, oleyl amine, etc. An example of a cycloaliphatic-substituted aliphatic amine is 2-(cyclohexyl)-ethyl amine. Examples of heterocyclic-substituted aliphatic amines include 2-(2-aminoethyl)-pyrrole, 2-(2-aminoethyl)-1-methylpyrrole, 2-(2-aminoethyl)-1-methylpyrrolidine and 4-(2-aminoethyl)morpholine, 1-(2-aminoethyl)piperazine, 1-(2-aminoethyl) piperidine, 2-(2-aminoethyl)pyridine, 1-(2-aminoethyl) pyrrolidine, 1-(3-aminopropyl)imidazole, 3-(2-aminopropyl)indole, 4-(3-aminopropyl)morpholine, 1-(3-aminopropyl)-2-pipecoline, 1-(3-aminopropyl)-2-pyrrolidinone, etc.

Illustrative cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentenylamines, N-ethyl-cyclohexylamine, dicyclohexylamines, and the like. Examples of aliphatic-substituted, aromatic-substituted, and heterocyclic-substituted cycloaliphatic mono amines include propyl-substituted cyclohexylamines, phenyl-substituted cyclopentylamines, and pyranyl-substituted cyclohexylamine.

Illustrative aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di-(para-methylphenyl)amine, naphthylamine, N-(n-butyl)-aniline, and the like. Examples of aliphatic-substituted, cycloaliphatic-substituted, and heterocyclic-substituted aromatic monoamines are para-ethoxy-aniline, para-dodecylaniline, cyclohexyl-substituted naphthylamine, variously substituted phenathiazines, and thienyl-substituted aniline.

Illustrative polyamines are aliphatic, cycloaliphatic and aromatic polyamines analogous to the above-described monoamines except for the presence within their structure of additional amino nitrogens. The additional amino nitrogens can be primary, secondary or tertiary amino nitrogens. Examples of such polyamines include N-amino-propyl-cyclohexylamines, N,N'-di-n-butyl-paraphenylene diamine, bis-(para-aminophenyl)methane, 1,4-diaminocyclohexane, and the like.

Illustrative hydroxy-substituted amines are those having hydroxy substituents bonded directly to a carbon atom other than a carbonyl carbon atom; that is, they have hydroxy groups capable of functioning as alcohols. Examples of such hydroxy-substituted amines include ethanolamine, di-(3-hydroxypropyl)-amine, 3-hydroxybutyl-amine, 4-hydroxybutyl-amine, diethanolamine, di-(2-hydroxyamine, N-(hydroxypropyl)-propylamine, N-(2-methyl)-cyclohexylamine, 3-hydroxycyclopentyl parahydroxyaniline, N-hydroxyethal piperazine and the like.

In one embodiment, the amines are alkylene polyamines including hydrogen, or a hydrocarbyl, amino hydrocarbyl, hydroxyhydrocarbyl or heterocyclic-substituted hydrocarbyl group containing up to about 10 carbon atoms. Examples of such alkylene polyamines include methylene polyamines, ethylene polyamines, butylene polyamines, propylene polyamines, pentylene polyamines, hexylene polyamines, heptylene polyamines, etc.

Alkylene polyamines include ethylene diamine, triethylene tetramine, propylene diamine, trimethylene diamine, hexamethylene diamine, decamethylene diamine, hexamethylene diamine, decamethylene diamine, octamethylene diamine, di(heptamethylene) triamine, tripropylene tetramine, tetraethylene pentamine, trimethylene diamine, pentaethylene hexamine, di(trimethylene)triamine, and the like. Higher homologs as are obtained by condensing two or more of the above-illustrated alkylene amines are useful, as are mixtures of two or more of any of the afore-described polyamines Ethylene polyamines, such as those mentioned above, are especially useful for reasons of cost and effectiveness. Such polyamines are described in detail under the heading "Diamines and Higher Amines" in The Encyclopedia of Chemical Technology, Second Edition, Kirk and Othmer, Volume 7, pages 27-39, Interscience Publishers, Division of John Wiley and Sons, 1965, which is hereby incorporated by reference for the disclosure of useful polyamines Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines.

Other useful types of polyamine mixtures are those resulting from stripping of the above-described polyamine mixtures. In this instance, lower molecular weight polyamines and volatile contaminants are removed from an alkylene polyamine mixture to leave as residue what is often termed "polyamine bottoms". In general, alkylene polyamine bottoms can be characterized as having less than 2, usually less than 1% (by weight) material boiling below about 200° C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Tex. designated "E-100". Gas chromatography analysis of such a sample showed it to contain about 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher analogs of diethylene triamine, triethylene tetramine and the like.

Illustrative dispersants are selected from: Mannich bases that are condensation reaction products of a high molecular weight phenol, an alkylene polyamine and an aldehyde such as formaldehyde; succinic-based dispersants that are reaction products of a olefin polymer and succinic acylating agent (acid, anhydride, ester or halide) further reacted with an organic hydroxy compound and/or an amine; high molecular weight amides and esters such as reaction products of a hydrocarbyl acylating agent and a polyhydric aliphatic alcohol (such as glycerol, pentaerythritol or sorbitol). Ashless (metal-free) polymeric materials that usually contain an oil soluble high molecular weight backbone linked to a polar functional group that associates with particles to be dispersed are typically used as dispersants. Zinc acetate capped, also any treated dispersant, which include borated, cyclic carbonate, end-capped, polyalkylene maleic anhydride and the like; mixtures of some of the above, in treat rates that range from about 0.1% up to 10-20% or more. Commonly used hydrocarbon backbone materials are olefin polymers and copolymers, i.e., ethylene, propylene, butylene, isobutylene, styrene; there may or may not be further functional groups incorporated into the backbone of the polymer, whose molecular weight ranges from 300 tp to 5000. Polar materials such as amines, alcohols, amides or esters are attached to the backbone via a bridge.

The dispersant(s) are preferably non-polymeric (e.g., mono- or bis-succinimides). Such dispersants can be prepared by conventional processes such as disclosed in U.S. Patent Application Publication No. 2008/0020950, the disclosure of which is incorporated herein by reference.

The dispersant(s) can be borated by conventional means, as generally disclosed in U.S. Pat. Nos. 3,087,936, 3,254,025 and 5,430,105.

Such dispersants may be used in an amount of about 0.01 to 20 weight percent or 0.01 to 10 weight percent, preferably about 0.5 to 8 weight percent, or more preferably 0.5 to 4 weight percent. Or such dispersants may be used in an amount of about 2 to 12 weight percent, preferably about 4 to 10 weight percent, or more preferably 6 to 9 weight percent. On an active ingredient basis, such additives may be used in an amount of about 0.06 to 14 weight percent, preferably about 0.3 to 6 weight percent. The hydrocarbon portion of the dispersant atoms can range from $C_{60}$ to $C_{1000}$, or from $C_{70}$ to $C_{300}$, or from $C_{70}$ to $C_{200}$. These dispersants may contain both neutral and basic nitrogen, and mixtures of both. Dispersants can be end-capped by borates and/or cyclic carbonates. Nitrogen content in the finished oil can vary from about 200 ppm by weight to about 2000 ppm by weight, preferably from about 200 ppm by weight to about 1200 ppm by weight. Basic nitrogen can vary from about 100 ppm by weight to about 1000 ppm by weight, preferably from about 100 ppm by weight to about 600 ppm by weight.

As used herein, the dispersant concentrations are given on an "as delivered" basis. Typically, the active dispersant is delivered with a process oil. The "as delivered" dispersant typically contains from about 20 weight percent to about 80 weight percent, or from about 40 weight percent to about 60 weight percent, of active dispersant in the "as delivered" dispersant product.

Antiwear Additives

The lubricating oil compositions include at least one antiwear agent. Examples of suitable antiwear agents include oil soluble amine salts of phosphorus compounds, sulphurized olefins, metal dihydrocarbyldithio-phosphates (such as zinc dialkyldithiophosphates), thiocarbamate-containing compounds, such as thiocarbamate esters, thiocarbamate amides, thiocarbamic ethers, alkylene-coupled thiocarbamates, and bis(S-alkyldithiocarbamyl) disulphides.

Antiwear agents used in the formulation of the lubricating oil may be ashless or ash-forming in nature. Preferably, the antiwear agent is ashless. So called ashless antiwear agents are materials that form substantially no ash upon combustion. For example, non-metal-containing antiwear agents are considered ashless.

In one embodiment, oil soluble phosphorus amine antiwear agents include an amine salt of a phosphorus acid ester or mixtures thereof. The amine salt of a phosphorus acid ester includes phosphoric acid esters and amine sails thereof; dialkyldithiophosphoric acid esters and amine salts thereof; amine salts of phosphites; and amine salts of phosphorus-containing carboxylic esters, ethers, and amides; and mixtures thereof. The amine salt of a phosphorus acid ester may be used alone or in combination.

In one embodiment, oil soluble phosphorus amine salts include partial amine salt-partial metal salt compounds or mixtures thereof. In one embodiment, the phosphorus compound further includes a sulphur atom in the molecule. In one embodiment, the amine salt of the phosphorus compound may be ashless, i.e., metal-free (prior to being mixed with other components).

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or in other embodiments 8 to 26, or 10 to 20, or 13 to 19 carbon atoms.

Primary amines include ethylamine, propylamine, butylamine, 2-ethylhexylamine, octylamine, and dodecylamine, as well as such fatty amines as n-octylamine, n-decylamine, n-dodeclyamine, n-tetradecylamine, n-hexadecylamine, n-octadecylamine and oleyamine. Other useful fatty amines include commercially available fatty amines such as "Armeen™" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dim ethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine and morpholine.

The amine may also be a tertiary-aliphatic primary amine The aliphatic group in this case may be an alkyl group containing 2 to 30, or 6 to 26, or 8 to 24 carbon atoms. Tertiary alkyl amines include monoamines such as tert-butylamine, tert-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanylamine, and tert-octacosanylamine.

In one embodiment, the phosphorus acid amine salt includes an amine with $C_{11}$ to $C_{14}$ tertiary alkyl primary groups or mixtures thereof. In one embodiment the phosphorus acid amine salt includes an amine with $C_{14}$ to $C_{18}$ tertiary alkyl primary amines or mixtures thereof. In one embodiment the phosphorus acid amine salt includes an amine with $C_{18}$ to $C_{22}$ tertiary alkyl primary amines or mixtures thereof.

Mixtures of amines may also be used in the disclosure. In one embodiment a useful mixture of amines is "Primene™ 81R" and "Primene™ JMT." Primene™ 81R and Primene™ JMT (both produced and sold by Rohm & Haas) are mixtures of $C_{11}$ to $C_{14}$ tertiary alkyl primary amines and $C_{18}$ to $C_{22}$ tertiary alkyl primary amines respectively.

In one embodiment, oil soluble amine salts of phosphorus compounds include a sulphur-free amine salt of a phosphorus-containing compound may be obtained/obtainable by a process comprising: reacting an amine with either (i) a hydroxy-substituted di-ester of phosphoric acid, or (ii) a phosphorylated hydroxy-substituted di- or tri-ester of phosphoric acid. A more detailed description of compounds of this type is disclosed in International Application PCT/US08/051126.

In one embodiment, the hydrocarbyl amine salt of an alkylphosphoric acid ester is the reaction product of a $C_{14}$ to $C_{18}$ alkylated phosphoric acid with Primene 81RT™ (produced and sold by Rohm & Haas) which is a mixture of $C_{11}$ to $C_{14}$ tertiary alkyl primary amines.

Examples of hydrocarbyl amine salts of dialkyldithiophosphoric acid esters include the reaction product(s) of isopropyl, methyl-amyl (4-methyl-2-pentyl or mixtures thereof), 2-ethylhexyl, heptyl, octyl or nonyl dithiophosphoric acids with ethylene diamine, morpholine, or Primene 81R™, and mixtures thereof.

In one embodiment, the dithiophosphoric acid may be reacted with an epoxide or a glycol. This reaction product is further reacted with a phosphorus acid, anhydride, or lower ester. The epoxide includes an aliphatic epoxide or a styrene oxide. Examples of useful epoxides include ethylene oxide, propylene oxide, butene oxide, octene oxide, dodecene oxide, and styrene oxide. In one embodiment, the epoxide may be propylene oxide. The glycols may be aliphatic glycols having from 1 to 12, or from 2 to 6, or 2 to 3 carbon atoms. The dithiophosphoric acids, glycols, epoxides, inorganic phosphorus reagents and methods of reacting the same are described in U.S. Pat. Nos. 3,197,405 and 3,544,465. The resulting acids may then be salted with amines.

The dithiocarbamate-containing compounds may be prepared by reacting a dithiocarbamate acid or salt with an unsaturated compound. The dithiocarbamate containing compounds may also be prepared by simultaneously reacting an amine, carbon disulphide and an unsaturated compound. Generally, the reaction occurs at a temperature from 25° C. to 125° C.

Examples of suitable olefins that may be sulphurised to form the sulphurised olefin include propylene, butylene, isobutylene, pentene, hexane, heptene, octane, nonene, decene, undecene, dodecene, undecyl, tridecene, tetradecene, pentadecene, hexadecene, heptadecene, octadecene, octadecenene, nonodecene, eicosene or mixtures thereof. In one embodiment, hexadecene, heptadecene, octadecene, octadecenene, nonodecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulphurised olefin includes fatty acids and their esters. The fatty acids are often obtained from vegetable oil or animal oil; and typically contain 4 to 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. In one embodiment fatty acids and/or ester are mixed with olefins.

Polyols include diols, triols, and alcohols with higher numbers of alcoholic OH groups. Polyhydric alcohols include ethylene glycols, including di-, tri- and tetraethylene glycols; propylene glycols, including di-, tri- and tetrapropylene glycols; glycerol; butane diol; hexane diol; sorbitol; arabitol; mannitol; sucrose; fructose; glucose; cyclohexane diol; erythritol; and penta-erythritols, including di- and tripentaerythritol. Often the polyol is diethylene glycol, triethylene glycol, glycerol, sorbitol, penta erythritol or dipentaerythritol.

In an alternative embodiment, the ashless antiwear agent may be a monoester of a polyol and an aliphatic carboxylic acid, often an acid containing 12 to 24 carbon atoms. Often the monoester of a polyol and an aliphatic carboxylic acid is in the form of a mixture with a sunflower oil or the like, which may be present in the mixture from 5 to 95, in several embodiments from 10 to 90, or from 20 to 85, or 20 to 80 weight percent of said mixture. The aliphatic carboxylic acids (especially a monocarboxylic acid) which form the esters are those acids typically containing 12 to 24, or from 14 to 20 carbon atoms. Examples of carboxylic acids include dodecanoic acid, stearic acid, lauric acid, behenic acid, and oleic acid.

Illustrative antiwear additives useful in this disclosure include, for example, metal salts of a carboxylic acid. The metal is selected from a transition metal and mixtures thereof. The carboxylic acid is selected from an aliphatic carboxylic acid, a cycloaliphatic carboxylic acid, an aromatic carboxylic acid, and mixtures thereof.

The metal is preferably selected from a Group 10, 11 and 12 metal, and mixtures thereof. The carboxylic acid is preferably an aliphatic, saturated, unbranched carboxylic acid having from about 8 to about 26 carbon atoms, and mixtures thereof.

The metal is preferably selected from nickel (Ni), palladium (Pd), platinum (Pt), copper (Cu), silver (Ag), gold (Au), zinc (Zn), and mixtures thereof.

The carboxylic acid is preferably selected from caprylic acid (C8), pelargonic acid (C9), capric acid (C10), undecylic acid (C11), lauric acid (C12), tridecylic acid (C13), myristic acid (C14), pentadecylic acid (C15), palmitic acid (C16), margaric acid (C17), stearic acid (C18), nonadecylic acid (C19), arachidic acid (C20), heneicosylic acid (C21), behenic acid (C22), tricosylic acid (C23), lignoceric acid (C24), pentacosylic acid (C25), cerotic acid (C26), and mixtures thereof.

Preferably, the metal salt of a carboxylic acid comprises zinc stearate, silver stearate, palladium stearate, zinc palmitate, silver palmitate, palladium palmitate, and mixtures thereof.

The metal salt of a carboxylic acid is present in the engine oil formulations of this disclosure in an amount of from about 0.01 weight percent to about 5 weight percent, based on the total weight of the formulated oil.

A metal alkylthiophosphate and more particularly a metal dialkyl dithio phosphate in which the metal constituent is zinc, or zinc dialkyl dithio phosphate (ZDDP) can be a useful component of the lubricating oils of this disclosure. ZDDP can be derived from primary alcohols, secondary alcohols or mixtures thereof. ZDDP compounds generally are of the formula $$Zn[SP(S)(OR^1)(OR^2)]_2$$

where $R^1$ and $R^2$ are $C_1$-$C_{18}$ alkyl groups, preferably $C_2$-$C_{12}$ alkyl groups. These alkyl groups may be straight chain or branched. Alcohols used in the ZDDP can be 2-propanol, butanol, secondary butanol, pentanols, hexanols such as 4-methyl-2-pentanol, n-hexanol, n-octanol, 2-ethyl hexanol, alkylated phenols, and the like. Mixtures of secondary alcohols or of primary and secondary alcohol can be preferred. Alkyl aryl groups may also be used.

Preferable zinc dithiophosphates which are commercially available include secondary zinc dithiophosphates such as those available from for example, The Lubrizol Corporation under the trade designations "LZ 677A", "LZ 1095" and "LZ 1371", from for example Chevron Oronite under the trade designation "OLOA 262" and from for example Afton Chemical under the trade designation "HITEC 7169".

The ZDDP is typically used in amounts of from about 0.4 weight percent to about 1.2 weight percent, preferably from about 0.5 weight percent to about 1.0 weight percent, and more preferably from about 0.6 weight percent to about 0.8 weight percent, based on the total weight of the lubricating oil, although more or less can often be used advantageously. Preferably, the ZDDP is a secondary ZDDP and present in an amount of from about 0.6 to 1.0 weight percent of the total weight of the lubricating oil.

Low phosphorus engine oil formulations are included in this disclosure. For such formulations, the phosphorus content is typically less than about 0.12 weight percent preferably less than about 0.10 weight percent and most preferably less than about 0.085 weight percent.

Other illustrative antiwear agents useful in this disclosure include, for example, zinc alkyldithiophosphates, aryl phosphates and phosphites, sulfur-containing esters, phosphosulfur compounds, and metal or ash-free dithiocarbamates.

The antiwear additive concentration in the lubricating oils of this disclosure can range from about 0.01 to about 5 weight percent, preferably about 0.1 to 4.5 weight percent, and more preferably from about 0.2 weight percent to about 4 weight percent, based on the total weight of the lubricating oil.

Extreme Pressure Agents

The lubricating oil compositions can include at least one extreme pressure agent (EP). EP agents that are soluble in the oil include sulphur- and chlorosulphur-containing EP agents, chlorinated hydrocarbon EP agents and phosphorus EP agents. Examples of such EP agents include chlorinated wax; sulphurised olefins (such as sulphurised isobutylene), organic sulphides and polysulphides such as dibenzyldisulphide, bis-(chlorobenzyl)disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithio carbamate and barium heptylphenol diacid; amine salts of alkyl and dialkylphosphoric acids or derivatives; and mixtures thereof (as described in U.S. Pat. No. 3,197,405).

The extreme pressure agents may be used in an amount of 0.01 to 5 wt %, preferably 0.01 to 1.5 wt %, more preferably 0.01 to 0.2 wt %, still more preferably 0.01 to 0.1 wt % (on an as-received basis) based on the total weight of the lubricating oil composition.

Ionic Liquids (ILs)

Ionic liquids are so-called salt melts which are preferably liquid at room temperature and/or by definition have a melting point<100° C. They have almost no vapor pressure and therefore have no cavitation properties. In addition, through the choice of the cations and anions in the ionic liquids, the lifetime and lubricating effect of the lubricating oil are increased, and by adjusting the electric conductivity, these liquids can be used in equipment in which there is an electric charge buildup, e.g., electric vehicle powertrains. Suitable cations for ionic liquids include a quaternary ammonium cation, a phosphonium cation, an imidazolium cation, a pyridinium cation, a pyrazolium cation, an oxazolium cation, a pyrrolidinium cation, a piperidinium cation, a thiazolium cation, a guanidinium cation, a morpholinium cation, a trialkylsulfonium cation or a triazolium cation, which may be substituted with an anion selected from the group consisting of $[PF_6]^-$, $[BF_4]^{31}$, $[CF_3CO_2]^{31}$, $[CF_3SO_3]^-$ as well as its higher homologs, $[C_4F_9—SO_3]^{31}$ or $[C_8F_{17}—SO_3]^-$ and higher perfluoroalkylsulfonates, $[(CF_3SO_2)_2N]^-$, $[(CF_3SO_2)(CF_3COO)N]^-$, $[R^1—SO_3]^-$, $[R^1—O—SO_3]^{31}$, $[R^1—COO]^-$, $Cr^-$, $Br^-$, $[NO_3]^-$, $[N(CN)_2]^-$, $[HSO_4]^-$, $PF_{(6-x)}R^3_x$ or $[R^1R^2PO_4]^-$ and the radicals $R^1$ and $R^2$ independently of one another are selected from hydrogen; linear or branched, saturated or unsaturated, aliphatic or alicyclic alkyl groups with 1 to 20 carbon atoms; heteroaryl, heteroaryl-$C_1$-$C_6$-alkyl groups with 3 to 8 carbon atoms in the heteroaryl radical and at least one heteroatom of N, O and S, which may be combined with at least one group selected from $C_1$-$C_6$ alkyl groups and/or halogen atoms; aryl-aryl $C_1$-$C_6$ alkyl groups with 5 to 12 carbon atoms in the aryl radical, which may be substituted with at least one $C_1$-$C_6$ alkyl group; $R^3$ may be a perfluoroethyl group or a higher perfluoroalkyl group, x is 1 to 4. However, other combinations are also possible.

Ionic liquids with highly fluorinated anions are especially preferred because they usually have a high thermal stability. The water uptake ability may definitely be reduced by such anions, e.g., in the case of the bis(trifluoromethylsutfonyl) imide anion.

Illustrative ionic liquids include, for example, butylmethylpyrrolidinium bis(trifluoromethylsulfonyl)imide (MBPimide), methylpropylpyrrolidinium bis(trifluoromethylsulfonyl)imide (MPPimide), hexylmethylimidazolium tris (perfluoroethyl)trifluorophosphate (HMIMPFET), hexylmethylimidazolium bis(trifluoromethylsulfonyl)imide (HMIMimide), hexylmethylpyrrolidinium bis(trifluoromethylsulfonyl)imide (HMP), tetrabutylphosphonium tris (perfluoroethyl)trifluorophosphate (BuPPFET), octylmethylimidazolium hexafluorophosphate (OMIM PF6), hexylpyridinium bis(trifluoromethyl)sulfonylimide (Hpyimide), methyltrioctylammonium trifluoroacetate (MOAac), butylmethylpyrrolidinium tris(pentafluoroethyl)trifluorophosphate (MBPPFET), trihexyl(tetradecyl)phosphonium bis(trifluoromethylsulfonyl)imide (HPDimide), 1-ethyl-3-methylimidazolium ethyl sulfate (EMIM ethyl sulfate), 1-ethyl-3-methylimidazolium bis(trifluoromethylsulfonyl) imide (EMIMimide), 1-ethyl-2,3-dimethylimidazolium bis (trifluoromethylsulfonyl)imide (EMMIMimide), N-ethyl-3-methylpyridinium nonafluorobutanesulfonate (EMPyflate), trihexyl(tetradecyl)phosphonium bis(trifluoromethylsulfonyl)amide, trihexyl(tetradecyl)phosphonium bis(2,4,4-trifluoromethylpentyl)phosphinate, tributyl(tetradecyl)phosphonium dodecylbenzenesulfonate, and the like.

Cation/anion combinations leading to ionic liquids include, for example, dialkylimidazolium, pyridinium, ammonium and phosphonium, etc. with organic anions such as sulfonates, imides, methides, etc., as well as inorganic anions such as halides and phosphates, etc., such that any other combination of cations and anions with which a low melting point can be achieved is also conceivable. Ionic liquids have an extremely low vapor pressure, depending on their chemical structure, are nonflammable and often have thermal stability up to more than 260° C. and furthermore are also suitable as lubricants.

The respective desired properties of the lubricant oil are achieved with the ionic liquids through a suitable choice of cations and anions. These desirable properties include adjusting electrical conductivity of the lubricant to spread the area of use, increasing the service life and lubricating effect of the lubricant, and adjusting the viscosity to improve the temperature suitability. Suitable cations for ionic liquids have proven to be a phosphonium cation, an imidazolium cation, a pyridinium cation or a pyrrolidinium cation which may be combined with an anion containing fluorine and selected from bis(trifluoromethylsulfonyl)imide, bis(perfluoroalkylsulfonyl)imide, perfluoroalkyl sulfonate, tris(perfluoroalkyl)methidenes, bis(perfluoroalkyl)imidenes, bis (perfluoroaryl)imides, perfluoroarylperfluoroalkylsulfonylimides and tris(perfluoro-alkyl) trifluorophosphate or with a halogen-free alkyl sulfate anion.

Ionic liquids are preferred with highly fluorinated anions because they usually have a high thermal stability. The water uptake ability may be reduced significantly by such anions, e.g., when using bis(trifluoromethylsulfonyl) anion.

In an embodiment, such ionic liquid additives may be used in an amount of about 0.1 to 10 weight percent, preferably 0.5 to 7.5 weight percent, more preferably about 0.75 to 5 weight percent.

Corrosion Inhibitors

The lubricating oil compositions include at least one corrosion inhibitor. Corrosion inhibitors are used to reduce the degradation of metallic parts that are in contact with the lubricating oil composition. Suitable corrosion inhibitors include aryl thiazines, alkyl substituted dimercaptothiodiazoles, alkyl substituted dimercaptothiadiazoles, and mixtures thereof.

Corrosion inhibitors are additives that protect lubricated metal surfaces against chemical attack by water or other contaminants. A wide variety of these are commercially available. As used herein, corrosion inhibitors include antirust additives and metal deactivators.

One type of corrosion inhibitor is a polar compound that wets the metal surface preferentially, protecting it with a film of oil. Another type of corrosion inhibitor absorbs water by incorporating it in a water-in-oil emulsion so that only the oil touches the metal surface. Yet another type of corrosion inhibitor chemically adheres to the metal to produce a non-reactive surface. Examples of suitable additives include zinc dithiophosphates, metal phenolates, basic metal sulfonates, fatty acids and amines Such additives may be used in an amount of about 0.01 to 5 weight percent, preferably about 0.01 to 1.5 weight percent.

Illustrative corrosion inhibitors include (short-chain) alkenyl succinic acids, partial esters thereof and nitrogen-containing derivatives thereof; and synthetic alkarylsulfonates, such as metal dinonylnaphthalene sulfonates. Corrosion inhibitors include, for example, monocarboxylic acids which have from 8 to 30 carbon atoms, alkyl or alkenyl succinates or partial esters thereof, hydroxy-fatty acids which have from 12 to 30 carbon atoms and derivatives thereof, sarcosines which have from 8 to 24 carbon atoms and derivatives thereof, amino acids and derivatives thereof, naphthenic acid and derivatives thereof, lanolin fatty acid, mercapto-fatty acids and paraffin oxides.

Particularly preferred corrosion inhibitors are indicated below. Examples of monocarboxylic acids ($C_8$-$C_{30}$), Caprylic acid, pelargonic acid, decanoic acid, undecanoic acid, lauric acid, myristic acid, palmitic acid, stearic acid, arachic acid, behenic acid, cerotic acid, montanic acid, melissic acid, oleic acid, docosanic acid, erucic acid, eicosenic acid, beef tallow fatty acid, soy bean fatty acid, coconut oil fatty acid, linolic acid, linoleic acid, tall oil fatty acid, 12-hydroxystearic acid, laurylsarcosinic acid, myritsylsarcosinic acid, palmitylsarcosinic acid, stearylsarcosinic acid, oleylsarcosinic acid, alkylated ($C_8$-$C_{20}$) phenoxyacetic acids, lanolin fatty acid and $C_8$-$C_{24}$ mercapto-fatty acids.

Examples of polybasic carboxylic acids which function as corrosion inhibitors include alkenyl ($C_{10}$-$C_{100}$) succinic acids and ester derivatives thereof, dimer acid, N-acyl-N-alkyloxyalkyl aspartic acid esters (U.S. Pat. No. 5,275,749). Examples of the alkylamines which function as corrosion inhibitors or as reaction products with the above carboxylates to give amides and the like are represented by primary amines such as laurylamine, coconut-amine, n-tridecylamine, myristylamine, n-pentadecylamine, palmitylamine, n-heptadecylamine, stearylamine, n-nonadecylamine, n-eicosylamine, n-heneicosylamine, n-docosylamine, n-tricosylamine, n-pentacosylamine, oleylamine, beef tallow-amine, hydrogenated beef tallow-amine and soy bean-amine Examples of the secondary amines include dilaurylamine, di-coconut-amine, di-n-tri decyl amine, dimyristylamine, di-n-pentadecylamine, dipalmitylamine, di-n-pentadecylamine, distearylamine, di-n-nonadecylamine, di-n-eicosylamine, di-n-heneicosylamine, di-n-docosylamine, di-n-tricosylamine, di-n-pentacosyl-amine, dioleylamine, di-beef tallow-amine, di-hydrogenated beef tallow-amine and di-soy bean-amine Examples of the aforementioned N-alkylpolyalkyenediamines include: ethylenediamines such as laurylethylenediamine, coconut ethylenediamine, n-tridecylethylenediamine-, myristylethylenediamine, n-pentadecylethylenediamine, palmitylethylenediamine, n-heptadecylethylenediamine, stearylethylenediamine, n-nonadecylethylenediamine, n-eicosylethylenediamine, n-heneicosylethylenediamine, n-docosylethylendiamine, n-tricosylethylenediamine, n-pentacosylethylenediamine, oleylethylenediamine, beef tallow-ethylenediamine, hydrogenated beef tallow-ethylenediamine and soy bean-ethylenediamine; propylenediamines such as laurylpropylenediamine, coconut propylenediamine, n-tridecylpropylenediamine, myristylpropylenediamine, n-pentadecylpropylenediamine, palmitylpropylenediamine, n-heptadecylpropylenediamine, stearylpropylenediamine, n-nonadecylpropylenediamine, n-eicosylpropylenediamine, n-heneicosylpropylenediamine, n-docosylpropylendiamine, n-tricosylpropylenediamine, n-pentacosylpropylenediamine, diethylene triamine (DETA) or triethylene tetramine (TETA), oleylpropylenediamine, beef tallow-propylenediamine, hydrogenated beef tallow-propylenediamine and soy bean-propylenediamine; butylenediamines such as laurylbutylenediamine, coconut butylenediamine, n-tridecylbutylenediamine-myristylbutylenediamine, n-pentadecylbutylenediamine, stearylbutylenediamine, n-eicosylbutylenediamine, n-heneicosylbutylenedia-mine, n-docosylbutylendiamine, n-tricosylbutylenediamine, n-pentacosylbutylenediamine, oleylbutylenediamine, beef tallow-butylenediamine, hydrogenated beef tallow-butylenediamine and soy bean butylenediamine; and pentylenediamines such as laurylpentylenediamine, coconut pentylenediamine, myristylpentylenediamine, palmitylpentylenediamine, stearylpentylenediamine, oleyl-pentylenediamine, beef tallow-pentylenediamine, hydrogenated beef tallow-pentylenediamine and soy bean pentylenediamine.

Other illustrative corrosion inhibitors include 2,5-dimercapto-1,3,4-thiadiazoles and derivatives thereof, mercaptobenzothiazoles, alkyltriazoles and benzotriazoles. Examples of dibasic acids useful as corrosion inhibitors, which may be used in the present disclosure, are sebacic acid, adipic acid, azelaic acid, dodecanedioic acid, 3-methyladipic acid, 3-nitrophthalic acid, 1,10-decanedicarboxylic acid, and fumaric acid. The corrosion inhibitors can be a straight or branch-chained, saturated or unsaturated monocarboxylic acid or ester thereof which may optionally be sulphurised in an amount up to 35% by weight. Preferably the acid is a $C_4$ to $C_{22}$ straight chain unsaturated monocarboxylic acid. The preferred concentration of this additive is from 0.001% to 0.35% by weight of the total lubricant composition. The preferred monocarboxylic acid is sulphurised oleic acid. However, other suitable materials are oleic acid itself; valeric acid and erucic acid. An illustrative corrosion inhibitor includes a triazole as previously defined. The triazole should be used at a concentration from 0.005% to 0.25% by weight of the total composition. The preferred triazole is tolylotriazole which may be included in the compositions of the disclosure include triazoles, thiazoles and certain diamine compounds which are useful as metal deactivators or metal passivators. Examples include triazole, benzotriazole and substituted benzotriazoles such as alkyl substituted derivatives. The alkyl substituent generally contains up to 1.5 carbon atoms, preferably up to 8 carbon atoms. The triazoles may contain other substituents on the aromatic ring such as halogens, nitro, amino, mercapto, etc. Examples of suitable compounds are benzotriazole and the tolyltriazoles, ethylbenzotriazoles, hexylbenzotriazoles, octylbenzotriazoles, chlorobenzotriazoles and nitrobenzotriazoles. Benzotriazole and tolyltriazole are particularly preferred. A straight or branched chain saturated or unsaturated monocarboxylic acid which is optionally sulphurised in an amount which may be up to 35% by weight; or an ester of such an acid; and a triazole or alkyl derivatives thereof, or short chain alkyl of up to 5 carbon atoms; n is zero or an integer between 1 and 3 inclusive; and is hydrogen, morpholino, alkyl, amido, amino, hydroxy or alkyl or aryl substituted derivatives thereof; or a triazole selected from 1,2,4 triazole, 1,2,3 triazole, 5-anilo-1,2,3,4-thiatriazole, 3-amino-1,2,4 triazole, 1-H-benzotriazole-1-yl-methylisocyanide, methylene-bis-benzotriazole and naphthotriazole.

The corrosion inhibitors may be used in an amount of 0.01 to 5 wt %, preferably 0.01 to 1.5 wt %, more preferably 0.01 to 0.2 wt %, still more preferably 0.01 to 0.1 wt % (on an as-received basis) based on the total weight of the lubricating oil composition.

Metal Passivators

The lubricating oil compositions include at least one metal passivator. The metal passivators/deactivators include, for example, benzotriazole, tolyltriazole, 2-mercaptobenzothiazole, dialkyl-2,5-dimercapto-1,3,4-thiadiazole; N,N'-disalicylideneethylenediamine, N,N'-disalicyli-denepropylenediamine; zinc dialkyldithiophosphates and dialkyl dithiocarbamates.

Some embodiments of the disclosure may further comprise a yellow metal passivator. As used herein, "yellow metal" refers to a metallurgical grouping that includes brass and bronze alloys, aluminum bronze, phosphor bronze, copper, copper nickel alloys, and beryllium copper. Typical yellow metal passivators include, for example, benzotriazole, totutriazole, tolyltriazole, mixtures of sodium tolutriazole and tolyltriazole, and combinations thereof. In one particular and non-limiting embodiment, a compound containing tolyltriazole is selected. Typical commercial yellow metal passivators include IRGAMET™-30, and IRGAMET™-42, available from Ciba Specialty Chemicals, now part of BASE, and VANLUBE™ 601 and 704, and CUVAN™ 303 and 484, available from R.T. Vanderbilt Company, Inc.

The metal passivator concentration in the lubricating oils of this disclosure can range from about 0.01 to about 5.0 weight percent, preferably about 0.01 to 3.0 weight percent, and more preferably from about 0.01 weight percent to about 1.5 weight percent, based on the total weight of the lubricating oil.

Antistatic Additives

In electric vehicle powertrains, static electricity is generated, especially when the lubricant is in use. To reduce that hazard, a conductive antistatic additive can be added to and distributed throughout the lubricating oil. This lubricating oil will thereby avoid reduction in its performance associated with local breakdown of the base stock and safety problems from static electric build-up.

A class of products called "antistatic fluids" or "antistatic additives", which also are petroleum distillates, can be added to adjust the conductivity of a lubricant oil to safe levels, e.g., at or above 100 pico-siemens per meter conductivity. Very small quantities of these antistatic fluids are required to raise the conductivity to the desired levels, namely, some 10 to 30 milliliters per 1,000 gallons of hydrocarbon.

According to another feature of the disclosure, the antistatic additive is selected from a population of commercially available materials based on the ability of the material's chemical compatibility with the lubricating oil and the cost effectiveness of adjusting the conductivity of the lubricating oil to the desired level for the lubricating oil's anticipated application.

Typical antistatic fluids are ExxonMobil™ Chemical's line of de-aromatized hydrocarbon fluids known as Exxsol™ fluids. Representative fluids and their distillation points include Exxsol™ antistatic fluids hexane (65 IBP (° C.) min, 71 DP (° C.) max, and additive amount 30 ml/1000 gal), D 40 (150 IBP (° C.) min, 210 DP (° C.) max, and additive amount 30 ml/1000 gal), D 3135 (152 IBP (° C.) min, 182 DP (° C.) max, and additive amount 10 ml/1000 gal), and D 60 (177 IBP (° C.) min, 220 DP (° C.) max, and additive amount 30 ml/1000 gal). The IBP is the temperature at which 1% of the material is distilled, and the DP is the temperature at which 96% of the material is distilled.

Other illustrative antistatic agents are based on long-chain aliphatic amines (optionally ethoxylated) and amides, quaternary ammonium salts (e.g., behentrimonium chloride or cocamidopropyl betaine), esters of phosphoric acid, polyethylene glycol esters, or polyols. Additional antistatic agents include long-chain alkyl phenols, ethoxylated amines, glycerol esters, such as glycerol monostearate, amides, glycols, and fatty acids.

The quantity of antistatic additive required to adjust the conductivity of the lubricating oil is determined by measuring the conductivity of the lubricating oil as the antistatic additive is mixed in and stopping when the desired conductivity consistent with the application to be reached. The amount of antistatic additive mixed in will range between 0.001% and 10% of the lubricating oil by weight, and preferentially between 1% and 7.5% by weight, though it may be mixed in at a liquid volume of between 10 and 100,000 parts per million.

Detergents

The lubricating oil compositions include at least one detergent. Illustrative detergents useful in this disclosure include, for example, alkali metal detergents, alkaline earth metal detergents, or mixtures of one or more alkali metal detergents and one or more alkaline earth metal detergents. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid (e.g., salicylic acid), phosphorous acid, phenol, or mixtures thereof. The counterion is typically an alkaline earth or alkali metal.

The detergent is preferably a metal salt of an organic or inorganic acid, a metal salt of a phenol, or mixtures thereof. The metal is preferably selected from an alkali metal, an alkaline earth metal, and mixtures thereof. The organic or inorganic acid is selected from an aliphatic organic or inorganic acid, a cycloaliphatic organic or inorganic acid, an aromatic organic or inorganic acid, and mixtures thereof.

The metal is preferably selected from an alkali metal, an alkaline earth metal, and mixtures thereof. More preferably, the metal is selected from calcium (Ca), magnesium (Mg), and mixtures thereof.

The organic acid or inorganic acid is preferably selected from a sulfur acid, a carboxylic acid, a phosphorus acid, and mixtures thereof.

Preferably, the metal salt of an organic or inorganic acid or the metal salt of a phenol comprises calcium phenate, calcium sulfonate, calcium salicylate, magnesium phenate, magnesium sulfonate, magnesium salicylate, and mixtures thereof.

Salts that contain a substantially stochiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased. These detergents can be used in mixtures of neutral, overbased, highly overbased calcium salicylate, sulfonates, phenates and/or magnesium salicylate, sulfonates, phenates. The TBN ranges can vary from low, medium to high TBN products, including as low as 0 to as high as 600. Preferably the TBN delivered by the detergent is between 1 and 20. More preferably between 1 and 12. Mixtures of low, medium, high TBN can be used, along with mixtures of calcium and magnesium metal based detergents, and including sulfonates, phenates, salicylates, and carboxylates. A detergent mixture with a metal ratio of 1, in conjunction of a detergent with a metal ratio of 2, and as high as a detergent with a metal ratio of 5, can be used. Borated detergents can also be used.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$ or mixtures thereof. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched and can be used from 0.5 to 6 weight percent. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are useful detergents. These carboxylic acid detergents may be prepared by reacting a basic metal compound with at least one carboxylic acid and removing free water from the reaction product. Detergents made from salicylic acid are one preferred class of detergents derived from carboxylic acids. Useful salicylates include long chain alkyl salicylates. One useful family of compositions is of the formula

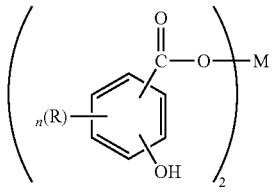

where R is an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

Alkaline earth metal phosphates are also used as detergents and are known in the art.

Detergents may be simple detergents or what is known as hybrid or complex detergents. The latter detergents can provide the properties of two detergents without the need to blend separate materials. See U.S. Pat. No. 6,034,039.

Illustrative detergents include calcium alkylsalicylates, calcium alkylphenates and calcium alkarylsulfonates with alternate metal ions used such as magnesium, barium, or sodium. Examples of the cleaning and dispersing agents which can be used include metal-based detergents such as the neutral and basic alkaline earth metal sulphonates, alkaline earth metal phenates and alkaline earth metal salicylates alkenylsuccinimide and alkenylsuccinimide esters and their borohydrides, phenates, salienius complex detergents and ashless dispersing agents which have been modified with sulphur compounds. These agents can be added and used individually or in the form of mixtures, conveniently in an amount within the range of from 0.01 to 1 part by weight per 100 parts by weight of base oil; these can also be high TBN, low TBN, or mixtures of high/low TBN.

Preferred detergents include calcium sulfonates, magnesium sulfonates, calcium salicylates, magnesium salicylates, calcium phenates, magnesium phenates, and other related components (including borated detergents), and mixtures thereof. Preferred mixtures of detergents include magnesium sulfonate and calcium salicylate, magnesium sulfonate and calcium sulfonate, magnesium sulfonate and calcium phenate, calcium phenate and calcium salicylate, calcium phenate and calcium sulfonate, calcium phenate and magnesium salicylate, calcium phenate and magnesium phenate.

The detergent concentration in the lubricating oils of this disclosure can range from about 0.01 to about 10 weight percent, preferably about 0.1 to 7.5 weight percent, and more preferably from about 0.5 weight percent to about 5 weight percent, based on the total weight of the lubricating oil.

As used herein, the detergent concentrations are given on an "as delivered" basis. Typically, the active detergent is delivered with a process oil. The "as delivered" detergent typically contains from about 20 weight percent to about 100 weight percent, or from about 40 weight percent to about 60 weight percent, of active detergent in the "as delivered" detergent product.

Viscosity Modifiers

Viscosity modifiers (also known as viscosity index improvers (VI improvers), and viscosity improvers) can be included in the lubricant compositions of this disclosure.

Viscosity modifiers provide lubricants with high and low temperature operability. These additives impart shear stability at elevated temperatures and acceptable viscosity at low temperatures.

Suitable viscosity modifiers include high molecular weight hydrocarbons, polyesters and viscosity modifier dispersants that function as both a viscosity modifier and a dispersant. Typical molecular weights of these polymers are between about 10,000 to 1,500,000, more typically about 20,000 to 1,200,000, and even more typically between about 50,000 and 1,000,000.

Examples of suitable viscosity modifiers are linear or star-shaped polymers and copolymers of methacrylate, butadiene, olefins, or alkylated styrenes. Polyisobutylene is a commonly used viscosity modifier. Another suitable viscosity modifier is polymethacrylate (copolymers of various chain length alkyl methacrylates, for example), some formulations of which also serve as pour point depressants. Other suitable viscosity modifiers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Olefin copolymers are commercially available from Chevron Oronite Company LLC under the trade designation "PARATONE®" (such as "PARATONE® 8921" and "PARATONE® 8941"); from Afton Chemical Corporation under the trade designation "HiTEC®" (such as "HiTEC® 5850B"; and from The Lubrizol Corporation under the trade designation "Lubrizol® 7067C". Hydrogenated polyisoprene star polymers are commercially available from Infineum International Limited, e.g., under the trade designation "SV200" and "SV600". Hydrogenated diene-styrene block copolymers are commercially available from Infineum International Limited, e.g., under the trade designation "SV 50".

The polymethacrylate or polyacrylate polymers can be linear polymers which are available from Evnoik Industries under the trade designation "Viscoplex®" (e.g., Viscoplex 6-954) or star polymers which are available from Lubrizol Corporation under the trade designation Asteric™ (e.g., Lubrizol 87708 and Lubrizol 87725).

Illustrative vinyl aromatic-containing polymers useful in this disclosure may be derived predominantly from vinyl aromatic hydrocarbon monomer. Illustrative vinyl aromatic-containing copolymers useful in this disclosure may be represented by the following general formula:

A-B wherein A is a polymeric block derived predominantly from vinyl aromatic hydrocarbon monomer, and B is a polymeric block derived predominantly from conjugated diene monomer.

In an embodiment of this disclosure, the viscosity modifiers may be used in an amount of less than about 10 weight percent, preferably less than about 7 weight percent, more preferably less than about 4 weight percent, and in certain instances, may be used at less than 2 weight percent, preferably less than about 1 weight percent, and more preferably less than about 0.5 weight percent, based on the total weight of the formulated oil or lubricating engine oil. Viscosity modifiers are typically added as concentrates, in large amounts of diluent oil.

The viscosity modifiers may be used in an amount of 0.01 to 20 wt %, preferably 0.1 to 10 wt %, more preferably 0.5 to 7.5 wt %, still more preferably 1 to 5 wt % (on an as-received basis) based on the total weight of the lubricating oil composition.

As used herein, the viscosity modifier concentrations are given on an "as delivered" basis. Typically, the active polymer is delivered with a diluent oil. The "as delivered" viscosity modifier typically contains from 20 weight percent to 75 weight percent of an active polymer for polymethacrylate or polyacrylate polymers, or from 8 weight percent to 20 weight percent of an active polymer for olefin copolymers, hydrogenated polyisoprene star polymers, or hydrogenated diene-styrene block copolymers, in the "as delivered" polymer concentrate.

Pour Point Depressants (PPDs)

Conventional pour point depressants (also known as lube oil flow improvers) may be added to the lubricating oil compositions of the present disclosure if desired. These pour point depressant may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715 describe useful pour point depressants and/or the preparation thereof. Such additives may be used in an amount of about 0.01 to 5 weight percent, preferably 0.1 to 3 weight percent, more preferably about 0.5 to 1.5 weight percent.

Seal Compatibility Agents

The lubricating oil compositions can include at least one seal compatibility agent. Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 5 weight percent, preferably 0.1 to 3 weight percent, more preferably about 0.5 to 1.5 weight percent.

Antifoam Agents

Antifoam agents may advantageously be added to lubricant compositions. These agents retard the formation of stable foams. Silicones and organic polymers are typical antifoam agents. For example, polysiloxanes, such as silicon oil or polydimethyl siloxane, provide antifoam properties. Antifoam agents are commercially available and may be used in conventional minor amounts along with other additives such as demulsifiers; usually the amount of these additives combined is less than 1 weight percent and often less than 0.1 weight percent. In an embodiment, such additives may be used in an amount of about 0.01 to 5 weight percent, preferably 0.1 to 3 weight percent, more preferably about 0.5 to 1.5 weight percent.

Friction Modifiers

The lubricating oil compositions can include at least one friction modifier. A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present disclosure if desired. Friction modifiers that lower the coefficient of friction are particularly advantageous in combination with the base oils and lube compositions of this disclosure.

Illustrative friction modifiers may include, for example, organometallic compounds or materials, or mixtures thereof. Illustrative organometallic friction modifiers useful in the lubricating engine oil formulations of this disclosure include, for example, molybdenum amine, molybdenum diamine, an organotungstenate, a molybdenum dithiocarbamate, molybdenum dithiophosphates, molybdenum amine complexes, molybdenum carboxylates, and the like, and mixtures thereof. Similar tungsten based compounds may be preferable.

Other illustrative friction modifiers useful in the lubricating engine oil formulations of this disclosure include, for example, alkoxylated fatty acid esters, alkanolamides, polyol fatty acid esters, borated glycerol fatty acid esters, fatty alcohol ethers, and mixtures thereof.

Illustrative alkoxylated fatty acid esters include, for example, polyoxyethylene stearate, fatty acid polyglycol ester, and the like. These can include polyoxypropylene stearate, polyoxybutylene stearate, polyoxyethylene isosterate, polyoxypropylene isostearate, polyoxyethylene palmitate, and the like.

Illustrative alkanolamides include, for example, lauric acid diethylalkanolamide, palmic acid diethylalkanolamide, and the like. These can include oleic acid diethyalkanolamide, stearic acid diethylalkanolamide, oleic acid diethylalkanolamide, polyethoxylated hydrocarbylamides, polypropoxylated hydrocarbylamides, and the like.

Illustrative polyol fatty acid esters include, for example, glycerol mono-oleate, saturated mono-, di-, and tri-glyceride esters, glycerol mono-stearate, and the like. These can include polyol esters, hydroxyl-containing polyol esters, and the like.

Illustrative borated glycerol fatty acid esters include, for example, borated glycerol mono-oleate, borated saturated mono-, di-, and tri-glyceride esters, borated glycerol monosterate, and the like. In addition to glycerol polyols, these can include trimethylolpropane, pentaerythritol, sorbitan, and the like. These esters can be polyol monocarboxylate esters, polyol dicarboxylate esters, and on occasion polyoltricarboxylate esters. Preferred can be the glycerol monooleates, glycerol dioleates, glycerol trioleates, glycerol monostearates, glycerol distearates, and glycerol tristearates and the corresponding glycerol monopalmitates, glycerol dipalmitates, and glycerol tripalmitates, and the respective isostearates, linoleates, and the like. On occasion the glycerol esters can be preferred as well as mixtures containing any of these. Ethoxylated, propoxylated, butoxylated fatty acid esters of polyols, especially using glycerol as underlying polyol can be preferred.

Illustrative fatty alcohol ethers include, for example, stearyl ether, myristyl ether, and the like. Alcohols, including those that have carbon numbers from $C_3$ to $C_{50}$, can be ethoxylated, propoxylated, or butoxylated to form the corresponding fatty alkyl ethers. The underlying alcohol portion can preferably be stearyl, myristyl, $C_{11}$-$C_{13}$ hydrocarbon, oleyl, isosteryl, and the like.

The lubricating oils of this disclosure exhibit desired properties, e.g., wear control, in the presence or absence of a friction modifier.

Useful concentrations of friction modifiers may range from 0.01 weight percent to 5 weight percent, or about 0.1 weight percent to about 2.5 weight percent, or about 0.1 weight percent to about 1.5 weight percent, or about 0.1 weight percent to about 1 weight percent. Concentrations of molybdenum-containing materials are often described in terms of Mo metal concentration. Advantageous concentrations of Mo may range from 25 ppm to 700 ppm or more, and often with a preferred range of 50-200 ppm. Friction modifiers of all types may be used alone or in mixtures with the materials of this disclosure. Often mixtures of two or more friction modifiers, or mixtures of friction modifier(s) with alternate surface active material(s), are also desirable.

When lubricating oil compositions contain one or more of the additives discussed above, the additive(s) are blended into the composition in an amount sufficient for it to perform its intended function. Typical amounts of such additives useful in the present disclosure are shown in Table 1 below.

It is noted that many of the additives are shipped from the additive manufacturer as a concentrate, containing one or more additives together, with a certain amount of base oil diluents. Accordingly, the weight amounts in Table 1 below, as well as other amounts mentioned herein, are directed to the amount of active ingredient (that is the non-diluent portion of the ingredient). The weight percent (wt %) indicated below is based on the total weight of the lubricating oil composition.

TABLE 1

Typical Amounts of Lubricating Oil Components

| Compound | Approximate wt % (Useful) | Approximate wt % (Preferred) |
|---|---|---|
| Antioxidant | 0.01-5 | 0.1-1.5 |
| Dispersant | 0.01-20 | 0.1-10 |
| Extreme Pressure Agent | 0-5 | 0.01-2 |
| Antiwear | 0.01-5 | 0.5-4 |
| Corrosion Inhibitor | 0.01-5 | 0.1-2 |
| Metal Passivator | 0.01-5 | 0.1-1.5 |
| Ionic Liquid | 0-10 | 0.1-5 |
| Pour Point Depressant | 0-5 | 0.01-1.5 |
| Antifoam Agent | 0-3 | 0.001-0.15 |
| Viscosity Modifier (solid polymer basis) | 0.01-20 | 0.1-10 |
| Friction Modifier | 0-5 | 0.1-1.5 |
| Detergent | 0.01-10 | 0.1-7.5 |

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account.

The following non-limiting examples are provided to illustrate the disclosure.

EXAMPLES

All of the ingredients used herein are commercially available. The AdPack additive package used herein is commercially available from Afton Chemical. Lubricating oil formulations were prepared as described herein.

The additive package used in the formulations included conventional additives in conventional amounts. Additives used in the formulations were one or more of an antioxidant, dispersant, ashless antiwear agent, extreme pressure agent, and metal (molybdenum). Optional additives were one or more of a corrosion inhibitor, metal passivator, pour point depressant, metal deactivator, seal compatibility additive, antifoam agent, and friction modifier.

Lubricating oils for use in a transmission, gear train, gear set, gear box, or gears of an electric or hybrid vehicle were prepared by blending at least one lubricating oil base stock selected from a Group IV base oil, Group V base oil, and combinations thereof, with one or more lubricating oil additives selected from an antioxidant, dispersant, ashless antiwear agent, extreme pressure agent, and metal (molybdenum).

Viscosity ($KV_{100}$) was measured according to ASTM D-445. Conductivity was measured according to the D2624 method at room temperature. Efficiency gain was assessed measuring the coefficient of traction at 80° C. and 1.25 GPa load using the MTM (Mini Traction Machine). This test was performed using the MTM instrument supplied by PCS- Instruments) using a ¾" (19.05 mm) diameter steel ball (AISI 52100) which was loaded and rotated against the flat surface of a rotating disk (AISI 52100). The disk was held in a bath containing the test lubricant so that the contact between the ball and flat was fully immersed. The ball shaft was aligned with respect to the disk so as to prevent spin in the contact and the slide to roll ratio was controlled independently by driving both the ball and disk with separate motors. Each candidate was tested varying the temperature between 40° C. and 140° C., while changing the Slide to Roll Ratio (SRR) between 0 and 100. The speed was 2 m/s and the load varied between 0.75 GPa and 1.25 GPa.

Some lubricating oils were also tested in a modified DIN ISO 14635 test (FZG Scuffing) to assess the durability performance. Metals content was determined by ASTM 6376.

The base oils used in the examples are listed in Table 2 below with the chemical structure. In FIGS. 1 and 2, the base oils are listed with the base oil number designated in Table 2.

TABLE 2

| Base Oil ## | Base Oil Name |
|---|---|
| Base Oil 1 | 2-ethylhexyl laurate |
| Base Oil 2 | Octyl Octanoate |
| Base Oil 3 | Isoamyl laurate |
| Base Oil 4 | α-hydro-ω-hydroxy-poly(oxy-1,4-butanediyl) |
| Base Oil 5 | Ethylene propylene copolymer |
| Base Oil 6 | Poly alpha olefin manufactured from decene feedstock |

FIG. 1 shows formulations and testing results for low viscosity gear oils having a constant amount of an additive package (i.e., AdPack).

In FIG. 1, all of the inventive examples (IE1-IE13) were designed targeting a viscosity ($KV_{100}$) of less than 7 cSt. They were formulated testing several base oils while maintaining constant the amount of the additives (i.e., AdPack). Additionally, in FIG. 1, all formulations were prepared capping the conductivity at 3,500 pS/m as measured by D2624 at room temperature. The coefficient of traction (CoT) was considered to be acceptable, if it was less than 0.0350 when measured at 80 C, 1.25 GPa load at 100% slide to roll ratio (SRR).

In comparison, a relatively heavier fluid designed to target viscosity ($KV_{100}$) above 8 cSt (comparative example CE #2), had a conductivity of 97,800 pS/m while providing a lower CoT. However, the trade-off between conductivity and coefficient of traction was considered to be more important when allowing to maintain a low conductivity.

In FIG. 1, it was noted that comparative example CE #1 was not homogenous.

To assess the durability, selected formulations were tested in a modified version of Method DIN ISO 14635 (FZG Scuffing), where the candidates were tested up to stage 13 instead of stopping at stage 12 as per method description. In particular inventive example IE #1 passed the 13 stages similarly to comparative example CE #2. Therefore, the viscosity reduction did not affect negatively the durability performance of the ultra-low viscosity fluid of this disclosure.

FIG. 2 shows formulations and testing results for low viscosity gear oils having varying amounts of additives.

In FIG. 2, additional formulations were prepared using base oil 1/base oil 2 combination similarly to inventive examples IE 1-3, but replacing the AdPack with individual additive components to provide more formulation flexibility. All formulations in FIG. 2 were blended targeting a viscosity ($KV_{100}$) less than 2 cSt. The conductivity was maintained below 13,000 pS/m. The conductivity of the inventive examples (IE 14-19) was higher than conductivity observed in FIG. 1 (inventive examples IE 1-10). However, the inventive examples (IE 14-19) are fit for use, and the conductivity is still significantly lower than what was measured in comparative example CE #2.

In accordance with this disclosure, ultra-low viscosity gear oils can be designed while controlling the conductivity and the coefficient of traction. This is a multidimensional fluid design where three variables are assessed at the same time. In FIG. 2, the coefficient of traction was higher than what was obtained with the higher viscosity fluid CE #2, but the coefficients of traction were still deemed acceptable. However, the increased coefficient of traction allows for improving two other key properties like viscosity and conductivity.

PCT and EP Clauses

1. A lubricating oil for use in an electric or hybrid vehicle, said lubricating oil having a composition comprising: one or more lubricating oil base stocks as a major component; and one or more lubricating oil additives, as a minor component; wherein the one or more lubricating oil base stocks comprise at least one Group IV base oil, or at least one Group V base oil; wherein the lubricating oil has a kinematic viscosity ($KV_{100}$) from 1 cSt to 7 cSt at 100° C. as determined by ASTM D-445, and an electrical conductivity at room temperature of less than 15,000 pS/m as determined by ASTM D-2624.

2. The lubricating oil of clause 1 which is a gear oil.

3. The lubricating oil of clauses 1 and 2 which is used in a transmission, gear train, gear set, gear box, or gears of an electric or hybrid vehicle.

4. The lubricating oil of clauses 1-3 having a kinematic viscosity ($KV_{100}$) from 1.5 cSt to 4 cSt at 100° C. as determined by ASTM D-445, and an electrical conductivity at room temperature of less than 12,000 pS/m as determined by ASTM D-2624.

5. The lubricating oil of clauses 1-3 having a coefficient of traction (CoT) of less than 0.0350 as measured using a mini traction machine (MTM) at 80° C. and 1.25 GPa load at 100% slide to roll ratio (SRR).

6. The lubricating oil of clauses 1-3 having a durability performance passing at least stage 12, as determined by method DIN ISO 14635 (FZG Scuffing).

7. The lubricating oil of clauses 1-6 wherein the one or more lubricating oil base stocks comprise: a Group V base stock, a Group IV base stock, a blend of Group V base stocks, a blend of Group IV base stocks, a blend of a Group V base stock and a Group IV base stock; a blend of a Group V base stock and a Group III base stock; a blend of a Group IV base stock and a Group III base stock; or a blend of a Group V base stock, a Group IV base stock and a Group III base stock.

8. The lubricating oil of clauses 1-7 wherein the one or more lubricating oil additives are selected from the group consisting of an antioxidant, antiwear agent, dispersant, corrosion inhibitor, ionic liquid, antistatic agent, pour point depressant, seal compatibility agent, antifoam agent, extreme pressure agent, metal passivator, and one or more metals.

9. The lubricating oil of clauses 1-8 wherein the one or more lubricating oil base stocks are present in an amount from 50 to 95 weight percent, based on the total weight of the lubricating oil.

10. The lubricating oil of clauses 1-9 wherein the one or more lubricating oil additives are present in an amount from 1 to 15 weight percent, based on the total weight of the lubricating oil.

11. The lubricating oil of clauses 1-10 having at least 90 weight percent of one or more lubricating oil base stocks; from 0.01 to 3 weight percent of one or more antioxidants; from 0.01 to 3 weight percent of one or more dispersants; from 0.01 to 2 weight percent of one or more antiwear agents; from 0.01 to 2 weight percent of one or more extreme pressure agents; and from 0.01 to 2 weight percent of one or more metals; wherein each weight percent is based on the total weight of the lubricating oil.

12. The lubricating oil of clause 11 wherein the one or more antioxidants comprise an amine antioxidant, a phenol antioxidant, or mixtures thereof.

13. A method for producing a lubricating oil for a transmission, gear train, gear set, gear box, or gears of an electric or hybrid vehicle, said method comprising:

providing one or more lubricating oil base stocks; wherein the one or more lubricating oil base stocks comprise at least one Group IV base oil, or at least one Group V base oil;

providing one or more lubricating oil additives; and blending the one or more lubricating oil base stocks and the one or more lubricating oil additives in amounts sufficient to produce the lubricating oil;

wherein the lubricating oil has a kinematic viscosity ($KV_{100}$) from 1 cSt to 7 cSt at 100° C. as determined by ASTM D-445, and an electrical conductivity at room temperature of less than 15,000 pS/m as determined by ASTM D-2624.

14. A method for improving energy efficiency, while maintaining or improving wear control, in a transmission, gear train, gear set, gear box, or gears of an electric or hybrid vehicle, said method comprising using a lubricant composition in the transmission, gear train, gear set, gear box, or gears of an electric or hybrid vehicle, the lubricant composition comprising: one or more lubricating oil base stocks as a major component; and one or more lubricating oil additives, as a minor component; wherein the one or more lubricating oil base stocks comprise at least one Group IV base oil, or at least one Group V base oil; wherein the lubricating oil has a kinematic viscosity ($KV_{100}$) from 1 cSt to 7 cSt at 100° C. as determined by ASTM D-445, and an electrical conductivity at room temperature of less than 15,000 pS/m as determined by ASTM D-2624.

15. A cooling fluid for use in an electric or hybrid vehicle, said cooling fluid having a composition comprising: one or more lubricating oil base stocks as a major component; and one or more lubricating oil additives, as a minor component; wherein the one or more lubricating oil base stocks comprise at least one Group IV base oil, or at least one Group V base oil; wherein the one or more lubricating oil additives comprise an antioxidant; and wherein the cooling fluid has a kinematic viscosity ($KV_{100}$) from 1 cSt to 7 cSt at 100° C. as determined by ASTM D-445.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

The invention claimed is:

1. A lubricating oil for use in an electric or hybrid vehicle, said lubricating oil having a composition comprising: one or more lubricating oil base stocks present in an amount from 50 to 95 weight percent, based on the total weight of the lubricating oil, as a major component; and one or more lubricating oil additives present in an amount from 1 to 15 weight percent, based on the total weight of the lubricating oil, as a minor component; wherein the one or more lubricating oil base stocks comprise a blend that includes one or more Group IV base oils; wherein the lubricating oil formulation is adjusted to have a kinematic viscosity ($KV_{100}$) from 1 cSt to 1.5 cSt at 100° C. as determined by ASTM D-445, an electrical conductivity at room temperature of less than 15,000 pS/m as determined by ASTM D-2624, and a coefficient of traction (CoT) of less than 0.0350 as measured using a mini traction machine (MTM) at 80° C. and 1.25 GPa load at 100% slide to roll ratio (SRR).

2. The lubricating oil of claim 1 which is a gear oil.

3. The lubricating oil of claim 1 which is used in a transmission, gear train, gear set, gear box, or gears of an electric or hybrid vehicle.

4. The lubricating oil of claim 1 having an electrical conductivity at room temperature of less than 12,000 pS/m as determined by ASTM D-2624.

5. The lubricating oil of claim 1 having a durability performance passing at least stage 12, as determined by method DIN ISO 14635 (FZG Scuffing).

6. The lubricating oil of claim 1 wherein the one or more lubricating oil base stocks further comprise: a Group V base stock, a blend of Group V base stocks, a blend of a Group V base stock and a Group IV base stock; a blend of a Group V base stock and a Group III base stock; a blend of a Group IV base stock and a Group III base stock; or a blend of a Group V base stock, a Group IV base stock and a Group III base stock.

7. The lubricating oil of claim 1 wherein the one or more lubricating oil additives are selected from the group consisting of an antioxidant, antiwear agent, dispersant, corrosion inhibitor, ionic liquid, antistatic agent, pour point depressant, seal compatibility agent, antifoam agent, extreme pressure agent, metal passivator, and one or more metals.

8. The lubricating oil of claim 1 having at least 90 weight percent of one or more lubricating oil base stocks; from 0.01 to 3 weight percent of one or more antioxidants; from 0.01 to 3 weight percent of one or more dispersants; from 0.01 to 2 weight percent of one or more antiwear agents; from 0.01 to 2 weight percent of one or more extreme pressure agents; and from 0.01 to 2 weight percent of one or more metals; wherein each weight percent is based on the total weight of the lubricating oil.

9. The lubricating oil of claim 8 wherein the one or more antioxidants comprise an amine antioxidant, a phenol antioxidant, or mixtures thereof.

10. A cooling fluid for use in an electric or hybrid vehicle, said cooling fluid having a composition comprising: one or more lubricating oil base stocks present at an amount from 50 to 95 weight percent, based on the total weight of the lubricating oil, as a major component; and one or more lubricating oil additives present at an amount from 1 to 15 weight percent, based on the total weight of the lubricating oil, as a minor component; wherein the one or more lubricating oil base stocks comprise a blend that includes one or more Group IV base oils; wherein the one or more lubricating oil additives comprise an antioxidant; and wherein the cooling fluid formulation is adjusted to have a kinematic viscosity ($KV_{100}$) from 1 cSt to 1.5 cSt at 100° C. as determined by ASTM D-445, an electrical conductivity at room temperature of less than 15,000 pS/m as determined by ASTM D-2624, and a coefficient of traction (CoT) of less than 0.0350 as measured using a mini traction machine (MTM) at 80° C. and 1.25 GPa load at 100% slide to roll ratio (SRR).

* * * * *